US010957269B2

(12) United States Patent
Park et al.

(10) Patent No.: US 10,957,269 B2
(45) Date of Patent: Mar. 23, 2021

(54) DISPLAY DEVICE

(71) Applicant: LG Display Co., Ltd., Seoul (KR)

(72) Inventors: Jongchan Park, Paju-si (KR); JinHwan Kim, Paju-si (KR); Hyunchul Um, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 312 days.

(21) Appl. No.: 15/823,393

(22) Filed: Nov. 27, 2017

(65) Prior Publication Data

US 2018/0315387 A1 Nov. 1, 2018

(30) Foreign Application Priority Data

Apr. 27, 2017 (KR) ..... 10-2017-0054089
Nov. 7, 2017 (KR) ..... 10-2017-0147276

(51) Int. Cl.
*G09G 3/36* (2006.01)
*G09G 3/3266* (2016.01)
*G09G 3/3275* (2016.01)

(52) U.S. Cl.
CPC ..... *G09G 3/3674* (2013.01); *G09G 3/3266* (2013.01); *G09G 3/3275* (2013.01);
(Continued)

(58) Field of Classification Search
CPC .. G09G 3/3674; G09G 3/3266; G09G 3/3275; G09G 2310/0275;
(Continued)

(56) References Cited

U.S. PATENT DOCUMENTS

2011/0279358 A1* 11/2011 Lee ..... G09G 3/3677 345/87
2012/0176348 A1* 7/2012 Kang ..... G09G 3/3208 345/204
(Continued)

FOREIGN PATENT DOCUMENTS

CN 1394320 A 1/2003
CN 1477909 A 2/2004
(Continued)

OTHER PUBLICATIONS

China National Intellectual Property Administration, Notification of the First Office Action, CN Patent Application No. 201711190639.0, dated Jan. 6, 2021, 32 pages.

*Primary Examiner* — Amr A Awad
*Assistant Examiner* — Maheen I Javed
(74) *Attorney, Agent, or Firm* — Fenwick & West LLP

(57) ABSTRACT

Disclosed is a display device for decreasing a load of a clock line. The display device comprises: a display panel including a plurality of data lines and a plurality of gate lines, and a plurality of pixels in a display area, a gate driver disposed in a non-display area of the display panel and supplying gate signals to the plurality of gate lines, and a gate control line for supplying a gate control signal to the gate driver. The gate control line includes a first gate control line and a second gate control line overlapping the first gate control line with an insulation layer therebetween, the second gate control line being connected to the first gate control line through a first contact hole passing through the insulation layer.

23 Claims, 15 Drawing Sheets

(52) U.S. Cl.
CPC ..... *G09G 2300/0426* (2013.01); *G09G 2310/0275* (2013.01); *G09G 2310/0286* (2013.01); *G09G 2310/0289* (2013.01); *G09G 2310/0291* (2013.01); *G09G 2310/08* (2013.01); *G09G 2320/0223* (2013.01)

(58) Field of Classification Search
CPC ... G09G 2310/0291; G09G 2310/0289; G09G 2300/0426; G09G 2310/0286; G09G 2320/0223; G09G 2310/08; G09G 3/20
See application file for complete search history.

(56) References Cited

U.S. PATENT DOCUMENTS

| | | | | |
|---|---|---|---|---|
| 2013/0009162 | A1 | 1/2013 | Kang | |
| 2015/0262528 | A1* | 9/2015 | Takahara ..... | G09G 3/3258 345/212 |
| 2016/0211309 | A1 | 7/2016 | Seo et al. | |
| 2016/0247478 | A1* | 8/2016 | Ishige ..... | G09G 3/3677 |

FOREIGN PATENT DOCUMENTS

| | | | |
|---|---|---|---|
| CN | 101504820 | A | 8/2009 |
| CN | 102074166 | A | 5/2011 |
| KR | 20130005877 | | 1/2013 |
| KR | 101314088 | | 10/2013 |
| KR | 101604492 | | 3/2016 |
| KR | 20160090456 | | 8/2016 |

* cited by examiner

DISPLAY DEVICE

CROSS-REFERENCE TO RELATED APPLICATIONS

This application claims the priority to Republic of Korea Patent Application No. 10-2017-0054089 filed on Apr. 27, 2017, and Republic of Korea Patent Application No. 10-2017-0147276 filed on Nov. 7, 2017 with the Korean Intellectual Property Office, both of which are incorporated herein by reference in their entirety.

BACKGROUND

Field of Technology

The present disclosure relates to a display device.

Discussion of the Related Art

With the advancement of information-oriented society, various requirements for display devices for displaying an image are increasing. Therefore, various kinds of panel display (PD) devices for decreasing the weight and volume of cathode ray tubes have been developed and become commercially available recently. For example, various PD devices such as non-emitting display devices such as liquid crystal display (LCD) devices and electroluminescence display devices such as organic light emitting diode (OLED) display devices and quantum dot light emitting display devices are being practically used.

Such PD devices each include a display panel that includes a plurality of data lines, a plurality of gate lines, and a plurality of pixels connected to the data lines and the gate lines, a gate driver GD that supplies gate signals to the gate lines, a data driver that supplies data voltages to the data lines, and a timing controller that controls an operation timing of the gate driver and an operation timing of the data driver. The gate driver GD, as in FIG. 1, may be provided in a non-display area except a display area AA of the display panel, and may include a plurality of stages each including a plurality of transistors. In this case, the gate driver GD receives clock signals CLK through clock lines CL and supplies the gate signals to the gate lines. In FIG. 1, for convenience of description, only one clock line is illustrated.

If a size of a PD device increases, a length of each of the clock lines CL extends, and for this reason, a load of each clock line CL increases. The increase in the load of each clock line CL can cause a delay of the clock signals CLK.

The clock signals CLK, as in FIG. 1, may be supplied from an integration driver ID into which the data driver and the timing controller are integrated. In this case, in the clock signals CLK, a period where a gate-off voltage Voff is shifted to a gate-on voltage Von increases in a direction from a first point P1, which is closest to the integration driver ID, to a third point P3 farthest away from the integration driver ID, and a period where the gate-on voltage Von is shifted to the gate-off voltage Voff increases. Due to the delay of the clock signals CLK, the gate driver GD is abnormally driven, or due to the insufficiency of a data voltage supply period of the pixels, luminance uniformity is reduced.

Furthermore, in the related art PD device, a cathode auxiliary electrode may be connected to a cathode electrode and may be provided in a non-display area to surround a display area, for stably supplying a low-level voltage to the cathode electrode. In this case, the cathode auxiliary electrode may be provided on the gate driver GD. An insulation layer in the display device may absorb water when exposed to air. Therefore, due to the covering of the cathode auxiliary electrode, water can remain on the insulation layer, and the light emitting element or the cathode electrode can be damaged. Furthermore, if the cathode auxiliary electrode overlaps the clock line CL, the low-level voltage supplied to the cathode auxiliary electrode can be effected by a parasitic capacitance generated between the cathode auxiliary electrode and the clock line CL.

SUMMARY

Accordingly, the present disclosure is directed to provide a display device that substantially obviates one or more problems due to limitations and disadvantages of the related art.

The present disclosure is directed to provide a display device for decreasing a load of a clock line.

Furthermore, the present disclosure is directed to provide a display device capable of preventing a light emitting layer or a cathode electrode from being damaged by water and reducing a degree to which a low-level voltage supplied to a cathode auxiliary electrode is affected by the parasitic capacitance.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display device comprising: a display panel including a plurality of data lines, a plurality of gate lines, and a plurality of pixels in a display area, a gate driver in a non-display area of the display panel and supplying gate signals to the plurality of gate lines, and a gate control line for supplying a gate control signal to the gate driver. The gate control line includes a first gate control line and a second gate control line overlapping the first gate control line with an insulation layer therebetween, the second gate control line being connected to the first gate control line through a first contact hole passing through the insulation layer.

In another aspect of the present disclosure, there is provided a display device comprising: a display panel including a plurality of data lines, a plurality of gate lines, and a plurality of pixels in a display area, a gate driver disposed in a non-display area of the display panel and including a plurality of stages, each of the plurality of stages connected to each of the plurality of gate lines, and a gate control line for supplying a gate control signal to the plurality of stages, and a cathode auxiliary electrode on the plurality of stages and the gate control line. The cathode auxiliary electrode includes a first outgas hole provided on the plurality of stages and a second outgas hole on the gate control line.

In another aspect of the present disclosure, there is provided a display device comprising: a display panel including a display area and non-display area adjacent to the display area; a gate driver in the non-display area of the display panel; a gate control line disposed for supplying a gate control signal to the gate driver; and a cathode auxiliary electrode disposed in the non-display area and including an outgas hole. The gate control line includes first and second gate control lines disposed on different layers, the first and second gate control lines being connected to each other through a contact hole.

In another aspect of the present disclosure, there is provided a display device comprising: a display panel including a display area and a non-display area adjacent to the display area and including a gate line, a data line, and a pixel provided in the display area; a gate driver including a stage for supplying a gate signal to the gate line, the gate driver being provided in the non-display area; a gate control line for supplying a gate control signal to the stage, the gate control line including a first clock line, a second clock line, and a start line; and a cathode auxiliary electrode overlapping the gate control line and the stage in the non-display area and including an opening corresponding to an area of the gate control line and an outgas hole corresponding to an area of the stage, wherein the first clock line, the second clock line, and the start line of the gate control line include a first line on a first insulation layer and a second line on the first line, and the second line is connected to the first line through a contact hole of a second insulation layer inserted between the second line and the first line.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
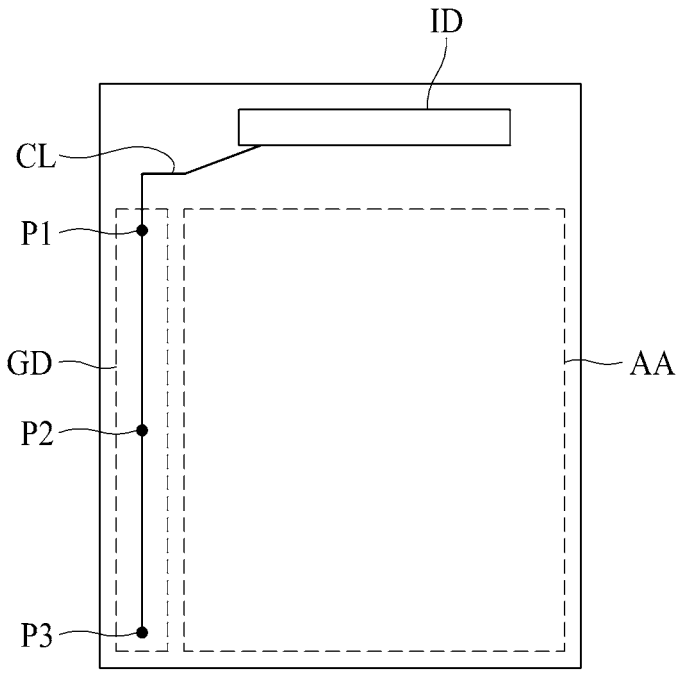
FIG. 1 RELATED ART
FIG. 1 is an exemplary diagram illustrating a clock line of a display device.
Figure 2:
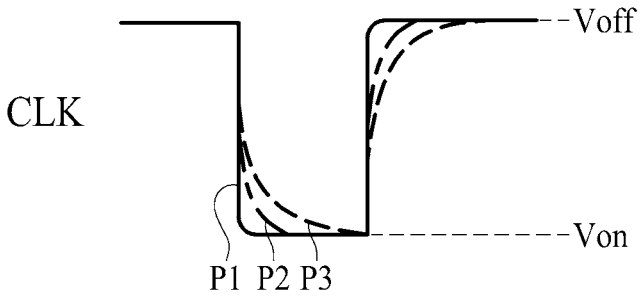
FIG. 2 RELATED ART
FIG. 2 is a waveform diagram showing clock signals at first to third points of the clock line of FIG. 1.

Reference will now be made in detail to the exemplary embodiments of the present disclosure, examples of which are illustrated in the accompanying drawings. Wherever possible, the same reference numbers will be used throughout the drawings to refer to the same or like parts.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~' and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the accompanying drawings.

Figure 3:
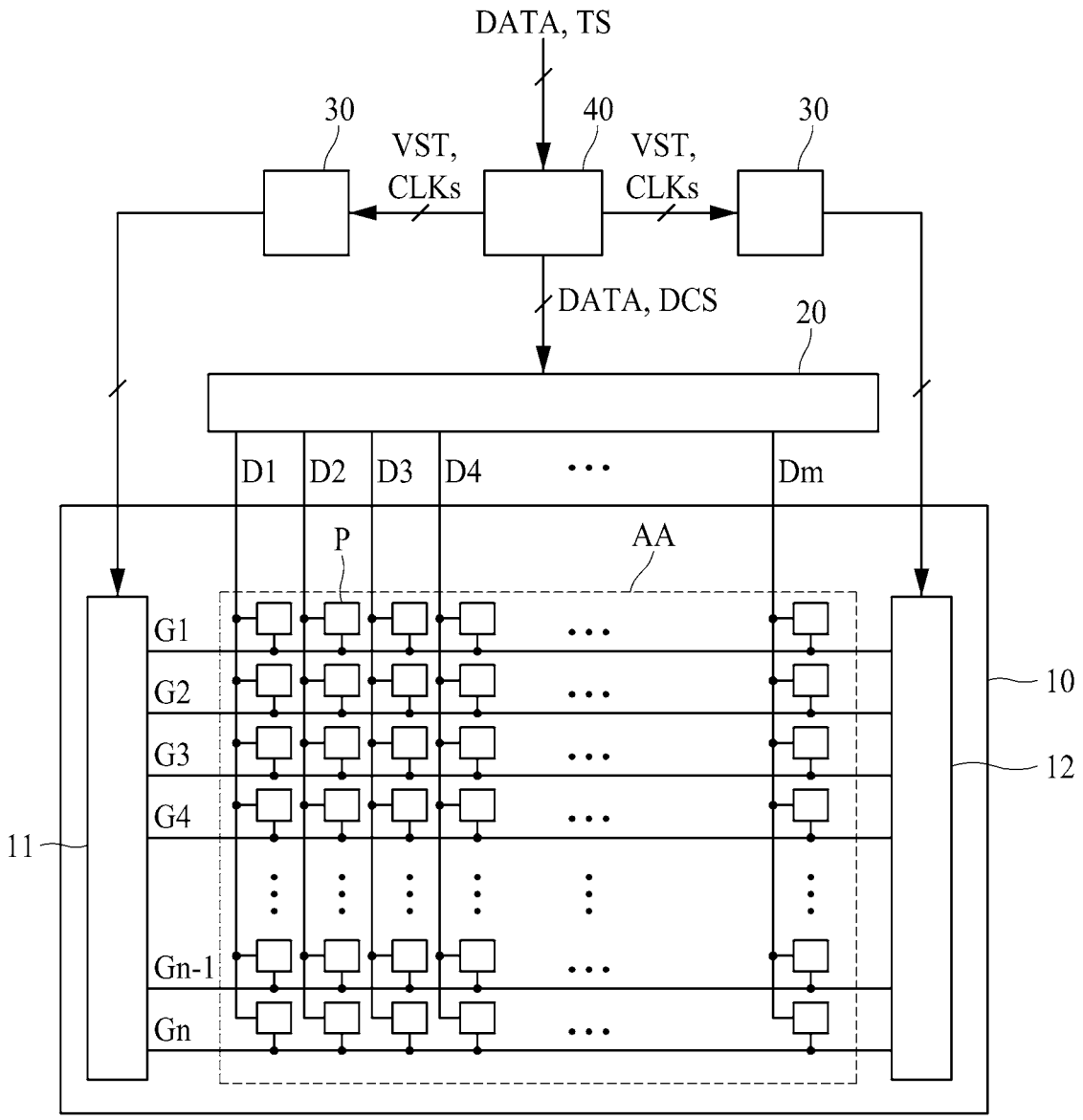
FIG. 3 is a block diagram schematically illustrating a display device according to an embodiment of the present disclosure.
Figure 4:
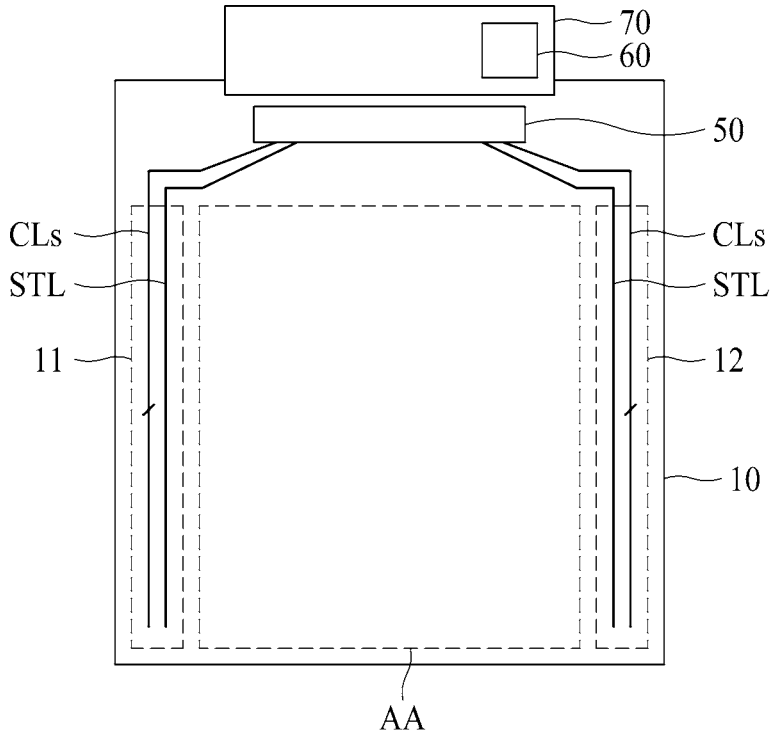
FIG. 4 is an exemplary diagram illustrating a lower substrate, an integration drive integrated circuit (IC), a flexible circuit board, and a power supply of a display device according to an embodiment of the present disclosure.

FIG. 3 is a block diagram schematically illustrating a display device according to an embodiment of the present disclosure. FIG. 4 is an exemplary diagram illustrating a lower substrate, an integration drive integrated circuit (IC), a flexible circuit board, and a power supply of a display device.

Examples of the display device according to an embodiment of the present disclosure may include all display devices that supply data voltages to a plurality of pixels in a line scanning method of supplying gate signals to a plurality of gate lines G1 to Gn. For example, the display device according to an embodiment of the present disclosure may be implemented with one of an LCD device, an organic light emitting display device, an electroluminescence display device, a quantum dot light emitting diode display device, and an electrophoresis display device. Hereinafter, an example where the display device according to an embodiment of the present disclosure is implemented with an organic light emitting display device will be described, but the present embodiment is not limited thereto.

Referring to FIGS. 3 and 4, the display device according to an embodiment of the present disclosure may include a display panel 10, a first gate driver 11, a second gate driver 12, an integration diver 50, a power supply 60, and a flexible circuit board 70. The integration driver 50 may include a data driver 20, a level shifter 30, and a timing controller 40.

The display panel 10 may include an upper substrate and a lower substrate. A display area AA, including plurality of data lines D1 to Dm (where m is an integer equal to or more than two), a plurality of gate lines G1 to Gn (where n is an integer equal to or more than two), and a plurality of pixels P, may be provided on the lower substrate. The data line D1 to Dm may be arranged to intersect the gate lines G1 to Gn. Each of the pixels P may be connected to one of the data lines D1 to Dm and one of the gate lines G1 to Gn. Each of the pixels P, as in FIG. 9, may be implemented with an organic light emitting diode (OLED) including an anode electrode, a light emitting layer, and a cathode electrode to emit light.

The first and second gate drivers 11 and 12 may be connected to the gate line G1 to Gn to supply gate signals. In detail, the first and second gate drivers 11 and 12 may receive a gate control signal, including clock signals CLKs and a start voltage VST, from the level shifter 30. The first and second gate drivers 11 and 12 may generate the gate signals, based on the clock signals CLKs and the start voltage VST and may output the gate signals to the gate line G1 to Gn.

The first and second gate drivers 11 and 12 may be provided in a non-display area in a gate driver in panel (GIP) type. For example, as in FIGS. 3 and 4, the first gate driver 11 may be provided outside one side of the display area AA, and the second gate driver 12 may be provided outside the other side of the display area AA. One of the first and second gate drivers 11 and 12 may be omitted, and in this case, one gate driver may be provided outside the one side of the display area AA.

The level shifter 30 may level-shift voltage levels of the start voltage VST and the clock signals CLKs, input from the timing controller 40, to a gate-off voltage Voff and a gate-on voltage Von for turning on a thin film transistor (TFT) provided in the display panel 10. The level shifter 30 may supply the level-shifted clock signals CLKs to the first and second gate drivers 11 and 12 through clock lines CLs and may supply the level-shifted start voltage (or a start signal) VST to the first and second gate drivers 11 and 12 through a start line STL. The clock lines CLs and the start line STL may be lines for transmitting the clock signals and the start signal corresponding to a gate control signal, and thus, in the present specification, the clock lines CLs and the start line STL may be referred to as a gate control line.

The data driver 20 may be connected to the data lines D1 to Dm. The data driver 20 may receive digital image data DATA and a data control signal DCS from the timing controller 40. The data driver 20 may convert the digital image data DATA into analog data voltages according to the data control signal DCS. The data driver 20 may supply the analog data voltages to the data lines D1 to Dm.

The timing controller 40 may receive digital video data DATA and timing signals TS from an external system board. The timing signals TS may include a vertical sync signal, a horizontal sync signal, and a data enable signal.

The timing controller 40 may generate the gate control signal for controlling an operation timing of each of the first and second gate drivers 11 and 12 and the data control signal DCS for controlling an operation timing of the data driver 20, based on the timing signals TS.

The data driver 20, the level shifter 30, and the timing controller 40 may be provided as one driving IC like the integration driver 50 of FIG. 4. However, an embodiment of the present disclosure is not limited thereto. In other embodiments, each of the data driver 20, the level shifter 30, and the timing controller 40 may be provided as a separate driving IC. The integration driver 50 may be directly attached on the lower substrate of the display panel 10 in a chip-on glass (COG) type or a chip-on plastic (COP) type.

The power supply 60 may generate a plurality of source voltages necessary for driving the pixels P like a VDD voltage and a VSS voltage, a gate driving voltage necessary for driving the first and second gate drivers 11 and 12 like the gate-on voltage Von and the gate-off voltage Voff, a source driving voltage necessary for driving the data driver 20, and a control driving voltage necessary for driving the timing controller 40. The power supply 60 may be mounted on the flexible circuit board 70 as in FIG. 4. The flexible circuit board 70 may be a flexible printed circuit board (FPCB).

Figure 5:
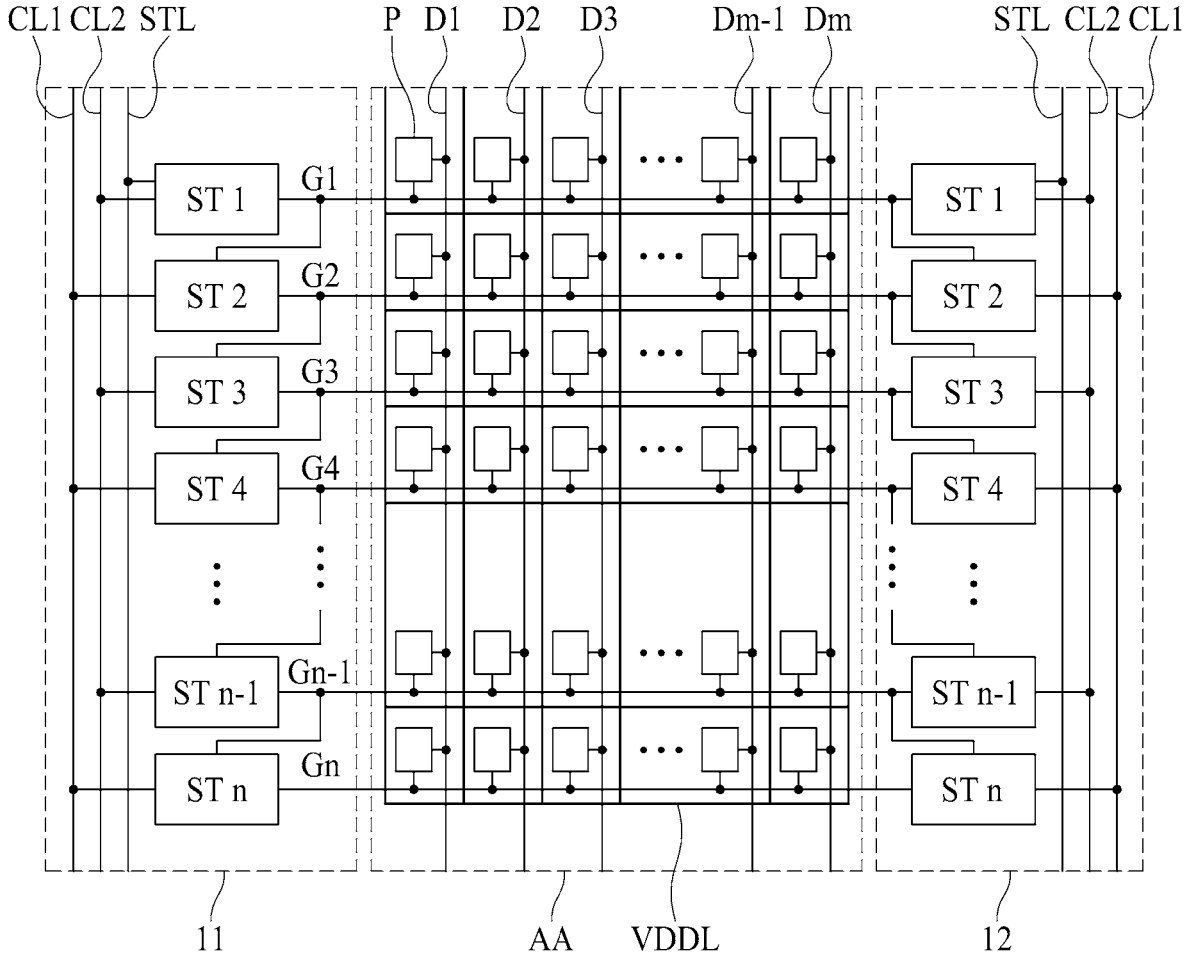
FIG. 5 is an exemplary diagram illustrating in detail a display area, a first gate driver, and a second gate driver of FIG. 4 according to an embodiment of the present disclosure.

FIG. 5 is an exemplary diagram illustrating in detail the display area, the first gate driver, and the second gate driver of FIG. 4.

Referring to FIG. 5, the plurality of pixels P may be respectively provided in a plurality of pixel areas defined by intersections of the data lines D1 to Dm and the gate lines G1 to Gn in the display area AA of the display panel 10. Also, a high level voltage line VDDL through which the high-level voltage is applied may be provided in a mesh structure to surround each of the pixels P. Since the high level voltage line VDDL is provided in the mesh structure, a high-level voltage difference caused by the drop of the high-level voltage is minimized.

Each of the first and second gate drivers 11 and 12 may include first to nth stages ST1 to STn. The first to nth stages ST1 to STn is connected to each of the gate lines respectively. Also, a start line STL is connected to the first stage ST1. Further, clock lines CL1, CL2 are connected alternately to the stages ST1 to STn. For example, a first clock line CL1 is connected to even stages ST2, ST4, . . . , STn, and a second clock line CL2 is connected to odd stages ST1, ST3, . . . , STn−1.

The kth stage STk (where k is a positive integer satisfying $1 \leq k \leq n$) may receive the start voltage of the start line STL or an output signal of a previous stage and a clock signal supplied through one of clock lines CL1 and CL2 and may output a clock signal, input to a kth gate line, as a gate signal. For example, the first stage ST1 may receive the start voltage of the start line STL and a second clock signal of a second clock line CL2 and may output a first gate signal to a first gate line GL1. The second stage ST2 may receive an output signal of the first stage ST1 and a first clock signal of a first clock line CL1 and may output a second gate signal to a second gate line GL2. In FIG. 5, for convenience of description, an example where clock signal lines are provided as two clock signal lines CL1 and CL2 is illustrated, but the present embodiment is not limited thereto. In other embodiments, the clock signal lines may be provided as three or more clock signal lines.

Figure 6:
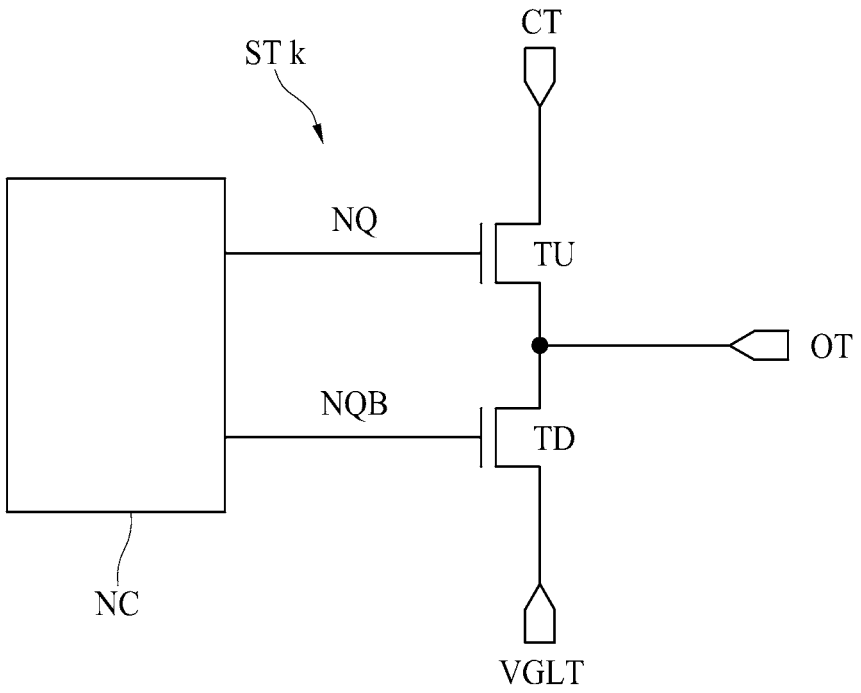
FIG. 6 is an exemplary diagram illustrating a kth stage of a first gate driver of FIG. 5 according to an embodiment of the present disclosure.

The kth stage STk, as in FIG. 6, may include a pull-up node NQ, a pull-down node NQB, a pull-up transistor TU, a pull-down transistor TD, and a node controller NC.

The pull-up transistor TU may be turned on when the pull-up node NQ is charged with the gate-on voltage. The pull-down transistor TD may be turned on when the pull-down node NQB is charged with the gate-on voltage.

The node controller NC may control charging/discharging of the pull-up node NQ and the pull-down node NQB. The node controller NC may control charging/discharging of the pull-up node NQ and the pull-down node NQB, based on a start terminal receiving the start signal or an output signal of a previous state and a clock terminal connected to one of the clock lines CLs receiving the clock signals. The node controller NC may further include a reset terminal receiving an output signal of a next stage, for controlling charging/discharging of the pull-up node NQ and the pull-down node NQB.

In detail, the node controller NC may control charging/discharging of the pull-up node NQ and the pull-down node NQB according to the start signal input to the start terminal or an output signal of a previous stage. In order to stably control an output of the kth stage STk, when the pull-up node NQ is charged with the gate-on voltage, the node controller NC may discharge the pull-down node NQB to the gate-off voltage, and when the pull-down node NQB is charged with the gate-on voltage, the node controller NC may discharge the pull-up node NQ to the gate-off voltage.

When the pull-up node NQ is charged with the gate-on voltage, the pull-up transistor TU may be turned on to output a clock signal, input to a clock terminal CT, to an output terminal OT. When the pull-down node NQB is charged with the gate-on voltage, the pull-down transistor TD may be turned on and may connect an output terminal OT to a gate-off voltage terminal VGLT to discharge the output terminal OT to the gate-off voltage.

As described above, when the start signal or the output signal of the previous stage is input, the kth stage STk may output the clock signal, input to the clock terminal CT, to the output terminal OT as a gate signal. Accordingly, in an embodiment of the present disclosure, the first to nth stages ST1 to STn of each of the first and second gate drivers 11 and 12 may sequentially generate outputs.

Figure 7:
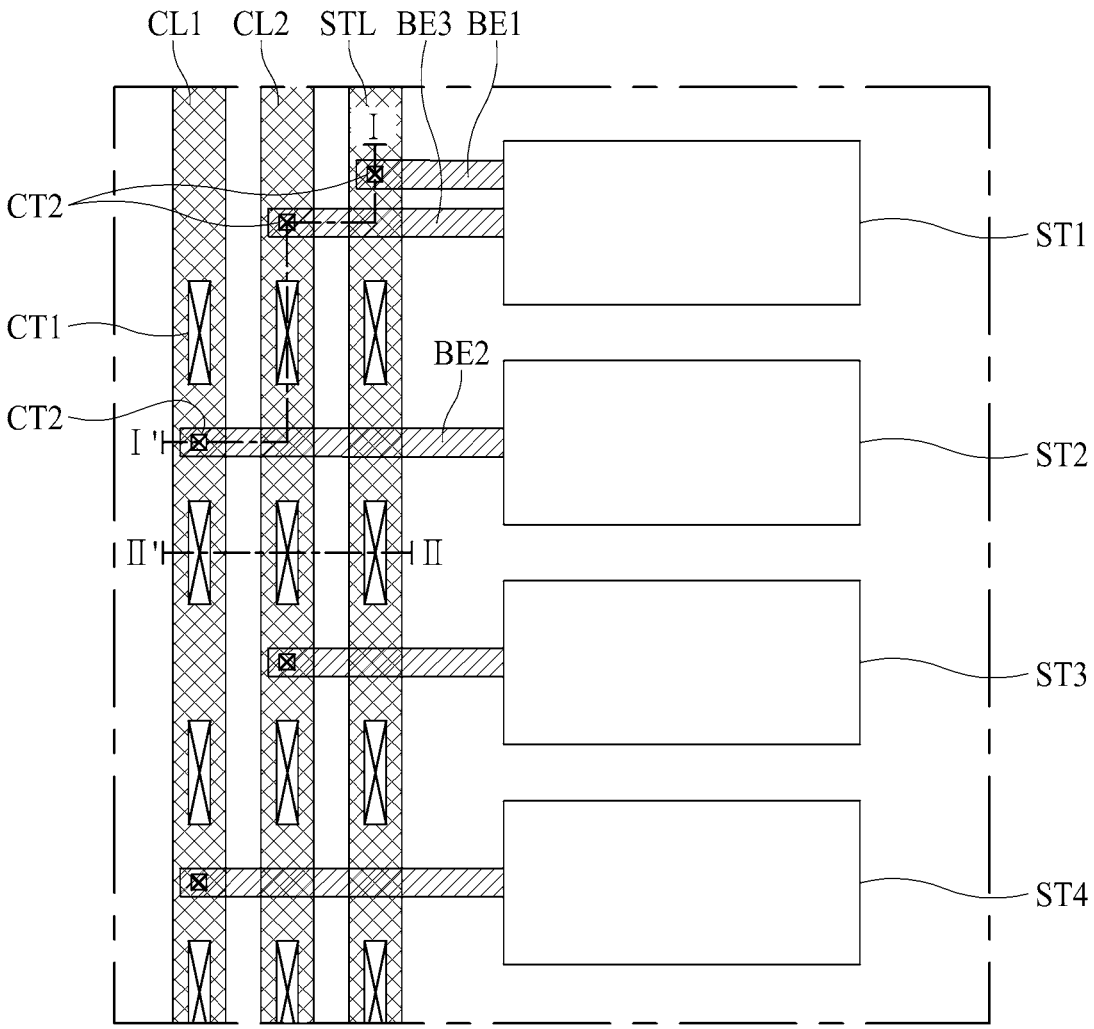
FIG. 7 is an exemplary diagram illustrating in detail a connection structure between first to fourth stages, first and second clock lines, and a start line in FIG. 5 according to an embodiment of the present disclosure.
Figure 8:
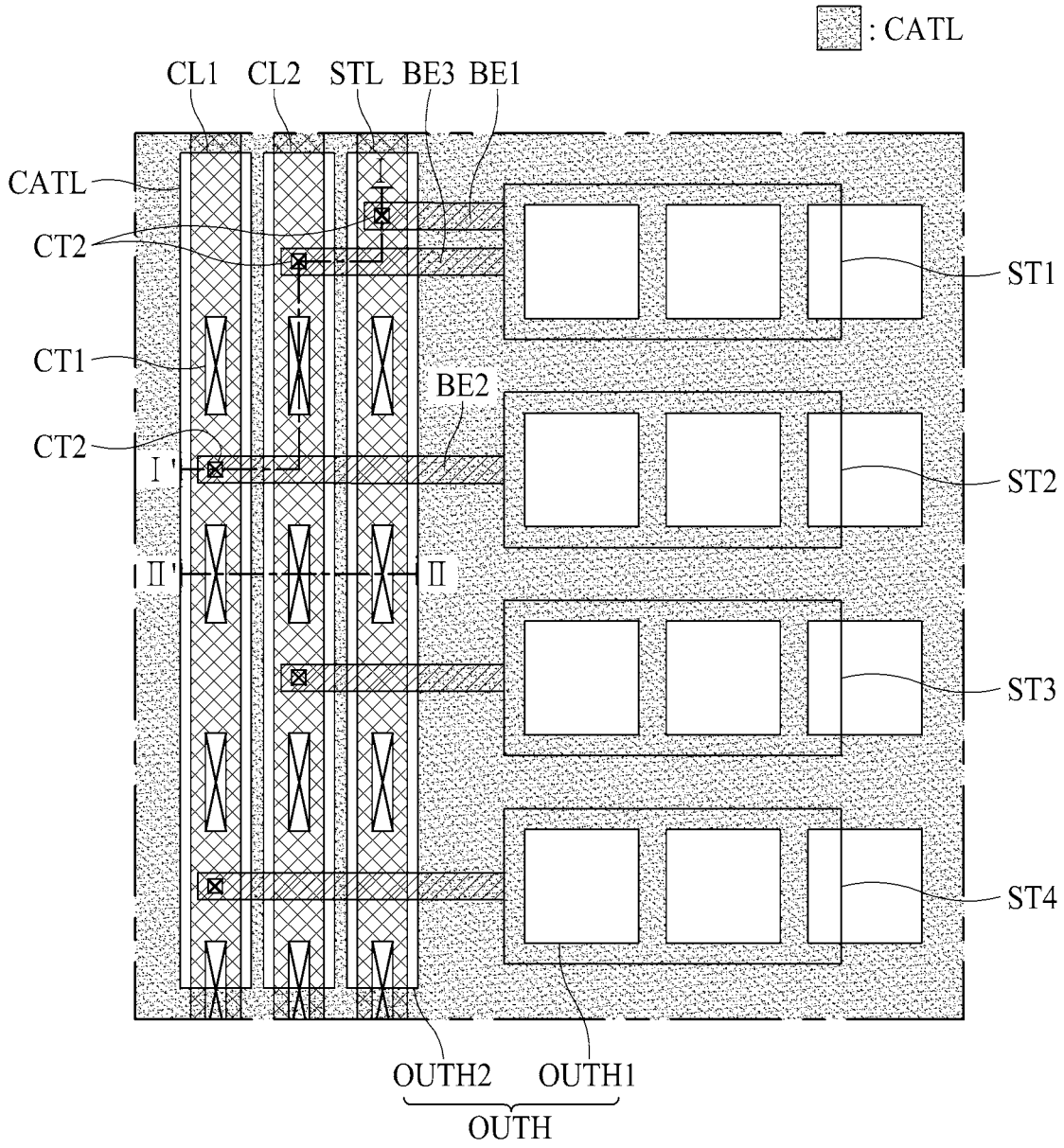
FIG. 8 is an exemplary diagram additionally illustrating a cathode auxiliary electrode provided on first to fourth stages, first and second clock lines, and a start line according to an embodiment of the present disclosure.

FIG. 7 is an exemplary diagram illustrating in detail a connection structure between the first to fourth stages, the first and second clock lines, and the start line in FIG. 5. FIG. 8 is an exemplary diagram additionally illustrating a cathode auxiliary electrode provided on the first to fourth stages, the first and second clock lines, and the start line.

Referring to FIG. 7, the clock lines CL1 and CL2 and the start line STL corresponding to the gate control line may each include first and second gate control lines disposed on different layers. The first and second gate control lines of each of the clock lines CL1 and CL2 and the start line STL may be connected to each other through a first contact hole CT1.

The start line STL may be connected to the first stage ST1 through a first bridge line BE1. The first bridge line BE1 may be connected to the start line STL through a second contact hole CT2.

The first clock line CL1 may be connected to some stages through a second bridge line BE2. In FIG. 7, the first clock line CL1 is illustrated as being connected to even-numbered stages ST2, ST4, . . . , and STn through the second bridge line BE2, but is not limited thereto. The second bridge line BE2 may be connected to the first clock line CL1 through the second contact hole CT2.

The second clock line CL2 may be connected to the other stages through a third bridge line BE3. In FIG. 7, the second clock line CL2 is illustrated as being connected to odd-numbered stages ST1, ST3, . . . , and STn−1 through the third bridge line BE3, but is not limited thereto. The third bridge line BE3 may be connected to the second clock line CL2 through the second contact hole CT2.

In order to enhance an effect of reducing the loads of the clock lines CL1 and CL2 and the start line STL corresponding to the gate control line, a contact area between the first and second gate control lines disposed on different layers may be enlarged. Accordingly, a size of the first contact hole CT1 contacting the first and second gate control lines may be greater than that of the second contact hole CT2.

Referring to FIG. 8, a cathode auxiliary electrode CATL may be connected to the cathode electrode and may be provided in the non-display area to surround the display area AA, for stably supplying the low-level voltage to the cathode electrode. In this case, the cathode auxiliary electrode CATL may be provided on the first and second gate drivers 11 and 12.

The cathode auxiliary electrode CATL may include an outgas hole OUTH for emitting an outgas of a planarization layer. The planarization layer may be formed of resin such as photo acryl, polyimide, and/or the like, and thus, may absorb water when exposed to air. Therefore, water can remain on the planarization layer, and the light emitting layer or the cathode electrode can be damaged by the outgas of the planarization layer. Accordingly, the outgas hole OUTH of the cathode auxiliary electrode CATL may provide a path through which the outgas of the planarization layer is emitted, thereby preventing the light emitting layer or the cathode electrode from being damaged by water.

The outgas hole OUTH may include a first outgas hole OUTH1, disposed on the stages ST1 to STn of the first and second gate drivers 11 and 12, and a second outgas hole OUTH2 disposed on the clock lines CL1 and CL2 and the start line STL corresponding to the gate control line.

If the cathode auxiliary electrode CATL overlaps the clock lines CL1 and CL2 and the start line STL, the low-level voltage supplied to the cathode auxiliary electrode CATL can be affected by a parasitic capacitance generated between the cathode auxiliary electrode CATL and each of the clock lines CL1 and CL2 and the start line STL. The second outgas hole OUTH2 may be provided on the clock lines CL1 and CL2 and the start line STL corresponding to the gate control line, for reducing a degree to which the low-level voltage supplied to the cathode auxiliary electrode CATL is affected by the parasitic capacitance.

Moreover, if an area of the cathode auxiliary electrode CATL is reduced due to the outgas hole OUTH, the low-level voltage supplied to the cathode auxiliary electrode CATL can be lowered due to voltage drop. Accordingly, a size of the first outgas hole OUTH1 provided on the stages ST1 to STn may be set less than that of the second outgas hole OUTH2 provided on the clock lines CL1 and CL2 and the start line STL corresponding to the gate control line.

However, the present disclosure is not limited to the above embodiment. In other embodiments, the outgas hole OUTH of the cathode auxiliary electrode CATL may be also provided in the non-display area other than the stages and the gate control lines.

As described above, in an embodiment of the present disclosure, the clock lines CL1 and CL2 and the start line STL corresponding to the gate control line may each include first and second gate control lines disposed on different layers. As a result, in an embodiment of the present disclosure, the loads of the clock lines CL1 and CL2 and the start line STL corresponding to the gate control line are reduced.

Figure 9:
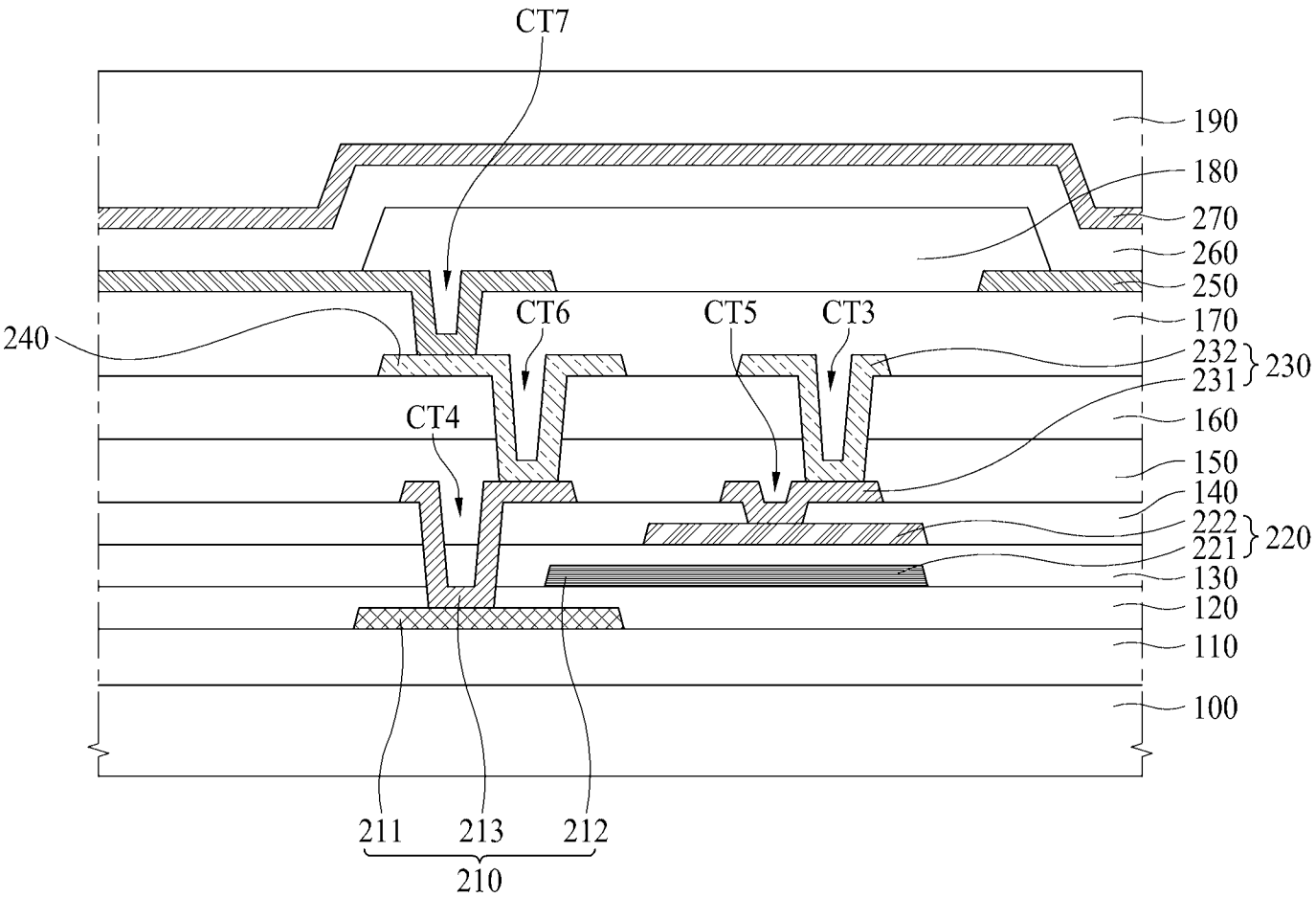
FIG. 9 is a cross-sectional view of a pixel of FIG. 5 according to an embodiment of the present disclosure.

FIG. 9 is a cross-sectional view of the pixel of FIG. 5. In FIG. 9, an example where a pixel P includes an OLED including an anode electrode 250, a light emitting layer 260, and a cathode electrode 270 will be mainly described below.

Referring to FIG. 9, a buffer layer 110 may be formed on one surface of a lower substrate 100. The lower substrate 100 may be a plastic film, a glass substrate, or the like, but is not limited thereto. The buffer layer 110 may be formed on the one surface of the lower substrate 100, for protecting a plurality of TFTs 210 and a plurality of light emitting devices from water which penetrates through the lower substrate 100 vulnerable to penetration of water. The buffer layer 110 may include a plurality of inorganic layers which are alternately stacked. For example, the buffer layer 110 may be formed of a multilayer where one or more inorganic layers of silicon oxide (SiOx) and silicon nitride (SiNx) are alternately stacked. The buffer layer 110 may be omitted.

A TFT 210, a capacitor 220, and a high level voltage line 230 may be provided on the buffer layer 110.

The TFT 210 may include an active layer 211, a gate electrode 212, a source electrode 213, and a drain electrode. In FIG. 9, the TFT 210 is exemplarily illustrated as being formed in a top gate type where the gate electrode 212 is disposed on the active layer 211, but is not limited thereto. In other embodiments, the TFT 210 may be formed in a bottom gate type where the gate electrode 212 is disposed under the active layer 211 or a double gate type where the gate electrode 212 is disposed both on and under the active layer 211. Also, in FIG. 9, for convenience of description, the drain electrode of the TFT 210 is not illustrated.

The capacitor 220 may include a first capacitor electrode 221 and a second capacitor electrode 222. The high level voltage line 230 may include first and second high level voltage lines 231 and 232.

In detail, the active layer 211 may be formed on the buffer layer 110. The active layer 211 may be formed of a silicon-based semiconductor material, an oxide-based semiconductor material, and/or the like. An insulation layer and a light blocking layer for blocking external light incident on the active layer 211 may be formed between the buffer layer 110 and the active layer 211.

A gate insulation layer 120 may be formed on the active layer 211. The gate insulation layer 120 may be formed of an inorganic layer, for example, silicon oxide (SiOx), silicon nitride (SiNx), or a multilayer thereof.

The gate electrode 212, the first capacitor electrode 221, and a gate line may be formed on the gate insulation layer 120. The gate electrode 212, the first capacitor electrode 221, and the gate line may each be formed of a single layer or a multilayer which includes one of molybdenum (Mo), aluminum (Al), chromium (Cr), gold (Au), titanium (Ti), nickel (Ni), neodymium (Nd), and copper (Cu), or an alloy thereof.

A first interlayer dielectric 130 may be formed on the gate electrode 212, the first capacitor electrode 221, and the gate line. The first interlayer dielectric 130 may be formed of an inorganic layer, for example, SiOx, SiNx, or a multilayer thereof.

The second capacitor electrode 222 may be formed on the first interlayer dielectric 130. The second capacitor electrode 222 may be formed of a single layer or a multilayer which includes one of Mo, Al, Cr, Au, Ti, Ni, Nd, and Cu, or an alloy thereof.

A second interlayer dielectric 140 may be formed on the second capacitor electrode 222. The second interlayer dielectric 140 may be formed of an inorganic layer, for example, SiOx, SiNx, or a multilayer thereof.

The source electrode 213, the drain electrode, the first high level voltage line 231, and a data line may be formed on the second interlayer dielectric 140. The source electrode 213 and the drain electrode may be connected to the active layer 211 through a fourth contact hole CT4 passing through the gate insulation layer 120 and the first and second interlayer dielectrics 130 and 140. The first high level voltage line 231 may be connected to the second capacitor electrode 222 through a fifth contact hole CT5 passing through the second interlayer dielectric 140. The source electrode 213, the drain electrode, the first high level voltage line 231, and the data line may each be formed of a single layer or a multilayer which includes one of Mo, Al, Cr, Au, Ti, Ni, Nd, and Cu, or an alloy thereof.

A passivation layer 150 for insulating the TFT 210 may be formed on the source electrode 213, the drain electrode, the first high level voltage line 231, and a data line. The passivation layer 150 may be formed of an inorganic layer, for example, SiOx, SiNx, or a multilayer thereof.

A first planarization layer 160 for planarizing a step height caused by the TFT 210 may be formed on the passivation layer 150. The first planarization layer 160 may be formed of an organic layer such as acryl resin, epoxy resin, phenolic resin, polyamide resin, polyimide resin, and/or the like.

An anode auxiliary electrode 240 and the second high level voltage line 232 may be formed on the first planarization layer 160. The anode auxiliary electrode 240 may be connected to the source electrode 213 through a sixth contact hole CT6 passing through the passivation layer 150 and the first planarization layer 160. The second high level voltage line 232 may be connected to the first high level voltage line 231 through a third contact hole CT3 passing through the passivation layer 150 and the first planarization layer 160. The anode auxiliary electrode 240 and the second high level voltage line 232 may each be formed of a single layer or a multilayer which includes one of Mo, Al, Cr, Au, Ti, Ni, Nd, and Cu, or an alloy thereof.

A second planarization layer 170 may be formed on the anode auxiliary electrode 240 and the second high level voltage line 232. The second planarization layer 170 may be formed of an organic layer such as acryl resin, epoxy resin, phenolic resin, polyamide resin, polyimide resin, and/or the like.

A light emitting device and a bank 180 may be formed on the second planarization layer 170. The light emitting device may include an anode electrode 250, a light emitting layer 260, and a cathode electrode 270.

The anode electrode 250 may be formed on the second planarization layer 170. The anode electrode 250 may be connected to the anode auxiliary electrode 240 through a seventh contact hole CT7 passing through the second planarization layer 170. The anode electrode 250 may be formed of Al, silver (Ag), Mo, a stacked structure (Mo/Ti) of Mo and Ti, copper (Cu), a stacked structure (Ti/Al/Ti) of Al and Ti, a stacked structure (ITO/Al/ITO) of Al and indium tin oxide (ITO), an APC alloy, a stacked structure (ITO/APC/ITO) of an APC alloy and ITO, and/or the like. The APC alloy may be an alloy of Ag, palladium (Pd), and Cu.

The bank 180 may be formed to cover an edge of the anode electrode 250. Therefore, an emissive area of the pixel P may be defined by the bank 180. The emissive area of the pixel P may denote an area where the anode electrode 250, the light emitting layer 260, and the cathode electrode 270 are sequentially stacked, and a hole from the anode electrode 250 and an electron from the cathode electrode 270 are combined with each other to emit light in the light emitting layer 260. In this case, an area where the bank 180 is provided does not emit, and thus, may be defined as a non-emissive area. The bank 180 may be formed of an organic layer such as acryl resin, epoxy resin, phenolic resin, polyamide resin, polyimide resin, and/or the like.

The light emitting layer 260 may be formed on the anode electrode 250 and the bank 180. The light emitting layer 260 may be a common layer which is formed in the pixels P in common, and may be a white light emitting layer that emits white light. In this case, the light emitting layer 260 may be formed in a tandem structure of two or more stacks. Each of the stacks may include a hole transporting layer, at least one light emitting layer, and an electron transporting layer. Also, a charge generating layer may be formed between the stacks.

The hole transporting layer may smoothly transfer a hole, injected from the anode electrode 250 or the charge generating layer, to the light emitting layer. The light emitting layer may be formed of an organic material including a phosphorescent material or a fluorescent material, and thus, may emit certain light. The electron transporting layer may smoothly transfer an electron, injected from the cathode electrode 270 or the charge generating layer, to the light emitting layer.

The charge generating layer may include an n-type charge generating layer, disposed adjacent to a lower stack, and a p-type charge generating layer which is formed on the n-type charge generating layer and is disposed adjacent to an upper stack. The n-type charge generating layer may inject an electron into the lower stack, and the p-type charge generating layer may inject a hole into the upper stack. The n-type charge generating layer may be formed of an organic layer which is doped with alkali metal, such as lithium (Li), sodium (Na), potassium (K), or cesium (Cs), or alkali earth metal such as magnesium (Mg), strontium (Sr), barium (Ba), or radium (Ra). The p-type charge generating layer may be an organic layer which is formed by doping a dopant on an organic host material having an ability to transport holes.

In FIG. 9, it is illustrated that the light emitting layer 260 is the common layer which is formed in the pixels P in common and is the white light emitting layer emitting the white light, but the present embodiment is not limited thereto. In other embodiments, the light emitting layer 260 may be individually provided in each of the pixels P, and in this case, each of the pixels P may be divided into a red pixel including a red light emitting layer emitting red light, a green pixel including a green light emitting layer emitting green light, and a blue pixel including a blue light emitting layer emitting blue light.

The cathode electrode 270 may be formed on the light emitting layer 260. The cathode electrode 270 may be a common layer which is formed in the pixels P in common. The cathode electrode 270 may be formed of a transparent conductive material (or TCO), such as indium tin oxide (ITO) or indium zinc oxide (IZO) capable of transmitting light, or a semi-transmissive conductive material such as Mg, Ag, or an alloy of Mg and Ag. In a case where the cathode electrode 270 is formed of the semi-transmissive conductive material, emission efficiency is enhanced by a micro-cavity. A capping layer may be formed on the cathode electrode 270.

An encapsulation layer 190 may be formed on the cathode electrode 270. The encapsulation layer 190 prevents oxygen or water from penetrating into the light emitting layer 260 and the cathode electrode 270. The encapsulation layer 190 may include at least one inorganic layer. The inorganic layer may be formed of silicon nitride, aluminum nitride, zirconium nitride, titanium nitride, hafnium nitride, tantalum nitride, silicon oxide, aluminum oxide, titanium oxide, and/or the like. Also, the encapsulation layer 190 may further include at least one organic layer, for preventing particles from penetrating into the light emitting layer 260 and the cathode electrode 270 via the inorganic layer.

A plurality of color filters and a black matrix may be disposed on the encapsulation layer 190. The color filters may respectively disposed in correspondence with the emissive areas of the pixels P. The black matrix may be disposed between the color filters and may be disposed in correspondence with the bank 180.

The color filters and the black matrix may be formed on an upper substrate, and the upper substrate may be adhered to a lower substrate by using by using an adhesive layer. In this case, the color filters may be respectively disposed in correspondence with the emissive areas of the pixels P, and the black matrix may be disposed between the color filters and may be disposed in correspondence with the bank 180. The adhesive layer may be a transparent adhesive film, a transparent adhesive resin, or the like. The upper substrate may be a plastic film, a glass substrate, an encapsulation film (a protective film), or the like.

Figure 10:
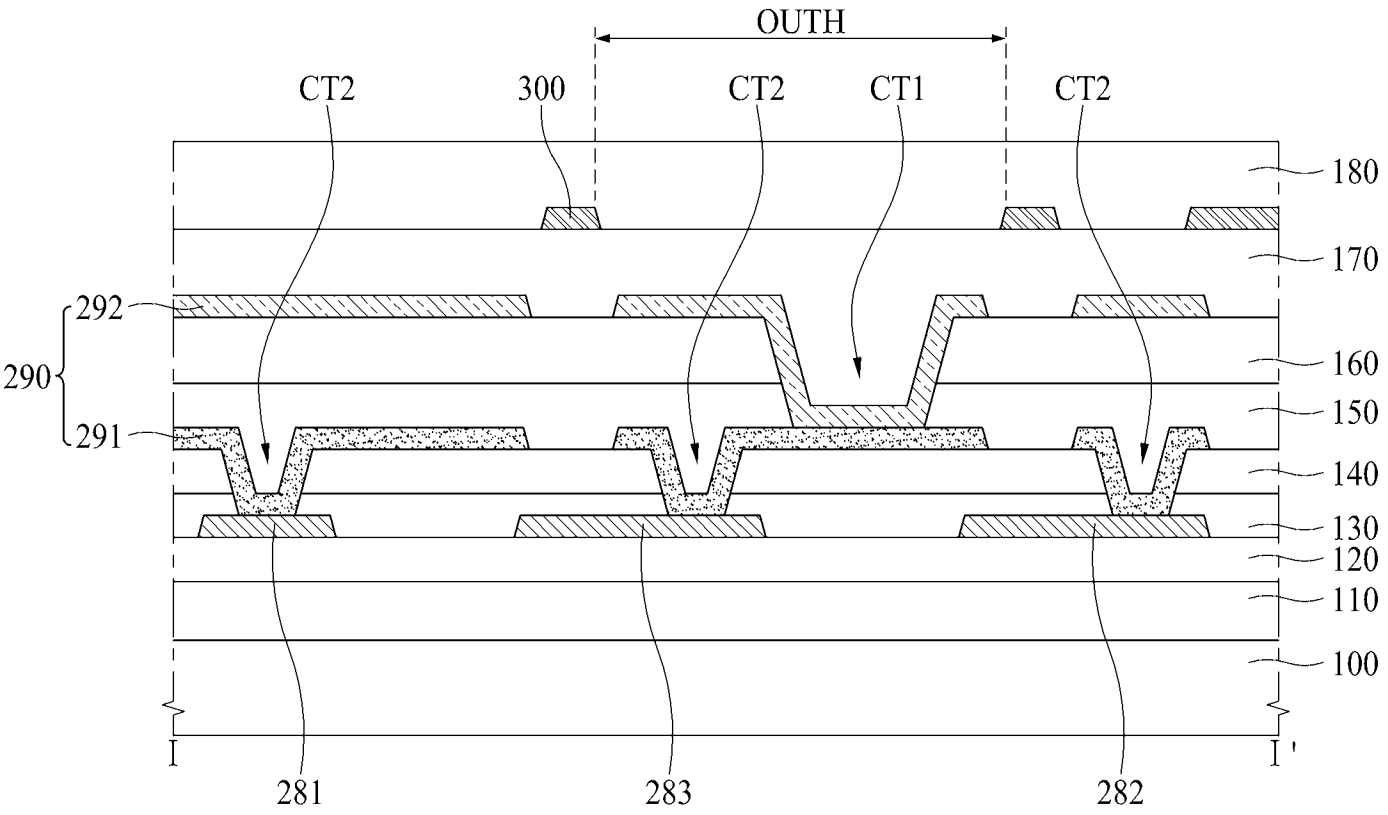
FIG. 10 is a cross-sectional view taken along line I-I' of FIG. 8 according to an embodiment of the present disclosure.
Figure 11:
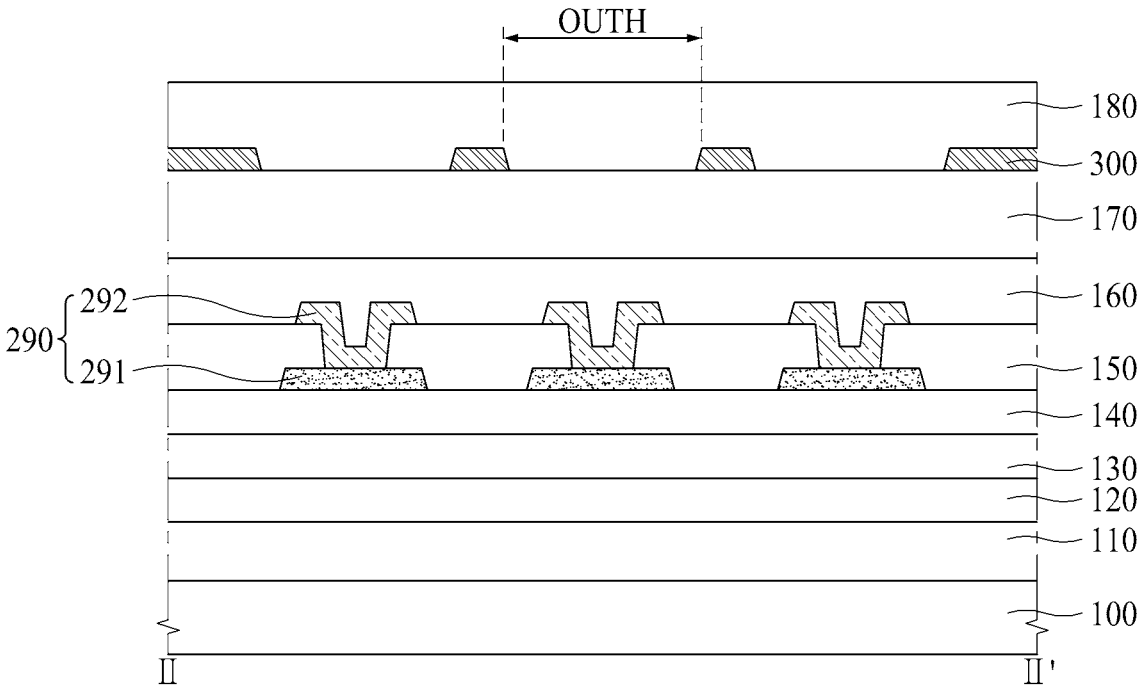
FIG. 11 is a cross-sectional view taken along line II-II' of FIG. 8 according to an embodiment of the present disclosure.

FIG. 10 is a cross-sectional view taken along line I-I' of FIG. 8. FIG. 11 is a cross-sectional view taken along line II-II' of FIG. 8.

In FIGS. 10 and 11, the lower substrate 100, the buffer layer 110, the gate insulation layer 120, the first interlayer dielectric 130, the second interlayer dielectric 140, the passivation layer 150, the first planarization layer 160, the second planarization layer 170, and the bank 180 are substantially the same as the elements described above with reference to FIG. 9, and thus, their detailed descriptions are omitted.

Referring to FIGS. 10 and 11, first to third bridge lines 281 to 283 may be formed on the gate insulation layer 120. That is, the first to third bridge lines 281 to 283 may be formed of the same material and on the same layer as the gate electrode 212 of the TFT 210 and the first capacitor electrode 221.

Alternatively, the first to third bridge lines 281 to 283 may be formed on the first interlayer dielectric 130. In this case, the first to third bridge lines 281 to 283 may be formed of the same material and on the same layer as the second capacitor electrode 222.

A gate control line 290 such as the first and second clock lines CL1 and CL2 and the start line STL may include first and second gate control lines 291 and 292.

The first gate control line 291 may be formed on the second interlayer dielectric 140. In this case, the first gate control line 291 may be formed of the same material and on the same layer as the source electrode 213 and the drain electrode of the TFT 210 and the first high level voltage line 231. The first gate control line 291 may be connected to each of the first to third bridge lines 281 to 283 through a second contact hole CT2 passing through the second interlayer dielectric 140 or the first and second interlayer dielectrics 130 and 140.

The second gate control line 292 may be formed on the first planarization layer 160. In this case, the second gate control line 292 may be formed of the same material and on the same layer as the anode auxiliary electrode 240 and the second high level voltage line 232. The second gate control line 292 may be connected to the first gate control line 291 through a first contact hole CT1 passing through the passivation layer 150 and the first planarization layer 160.

The cathode auxiliary electrode 300 may be formed on the second planarization layer 170, and the cathode auxiliary electrode 300 may be formed of the same material and on the same layer as the anode electrode 250. The outgas hole OUTH of the cathode auxiliary electrode 300 may be formed on the gate control line 290. Therefore, in an embodiment of the present disclosure, the cathode auxiliary electrode 300 may not overlap the gate control line 290, and thus, the low-level voltage supplied to the cathode auxiliary electrode 300 is prevented from being affected by a parasitic capacitance generated between the cathode auxiliary electrode 300 and the gate control line 290.

As described above, in an embodiment of the present disclosure, the second gate control line 292 may be provided in a space between two planarization layers (i.e., the first and second planarization layers 160 and 170) in the non-display area, and may be connected to the first gate control line 291 through the first contact hole CT1. As a result, in an embodiment of the present disclosure, the second gate control line 292 may be formed in the same process as a process of forming the anode auxiliary electrode 240 and the second high level voltage line 232, and thus, without adding a separate process, the loads of the clock lines CL1 and CL2 and the start line STL corresponding to the gate control line are reduced.

Figure 12:
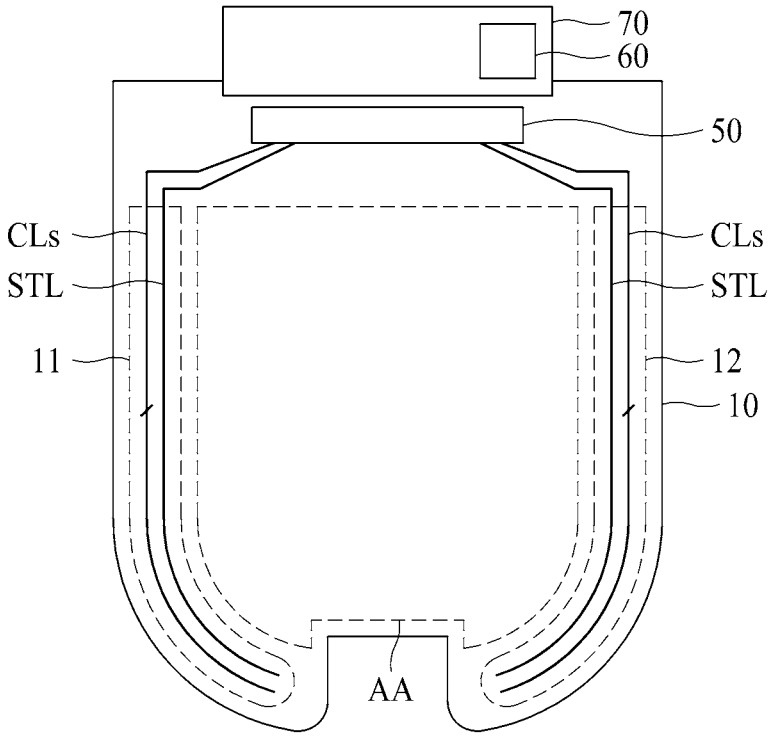
FIG. 12 is an exemplary diagram illustrating a lower substrate, an integration drive IC, a flexible circuit board, and a power supply of a display device according to an embodiment of the present disclosure.

FIG. 12 is an exemplary diagram illustrating a lower substrate, an integration drive IC, a flexible circuit board, and a power supply of a display device. A display panel 10, a first gate driver 11, a second gate driver 12, an integration diver 50, a power supply 60, and a flexible circuit board 70 are substantially the same as the elements described above with reference to FIG. 4, and thus, their detailed descriptions are omitted.

Referring to FIG. 12, at least two corners of the display panel 10 may have a round shape. Also, one side disposed between the two corners having a round shape may include a notch. The notch may denote an area which extends and protrudes from the one side of the display panel 10 to an inner portion of the display panel 10. For example, the notch may denote a groove which is provided in the one side of the display panel 10. A deformable shape is not limited to an example where a corner has a round shape or the notch, and may be various shapes such as an elliptical shape or a polygonal shape (a pentagonal shape, a hexagonal shape, etc.).

In an embodiment of the present disclosure, in a case where the display panel 10 is a deformable display panel, a deformable display panel including at least two corners having a round shape will be described below.

As illustrated in FIG. 12, if a corner of the display panel 10 has a round shape, a display area AA of the display panel 10 may also have the same shape as that of the display panel 10. Referring to FIG. 12, therefore, at least two corners of the display area AA may also have a round shape like the display panel 10. The first gate driver 11 dispose in a left portion in a non-display area of the display panel 10 and the second gate driver 12 dispose in a right portion in the non-display area of the display panel 10 may have a round shape along the round shape of the corner of the display panel 10.

Figure 13:
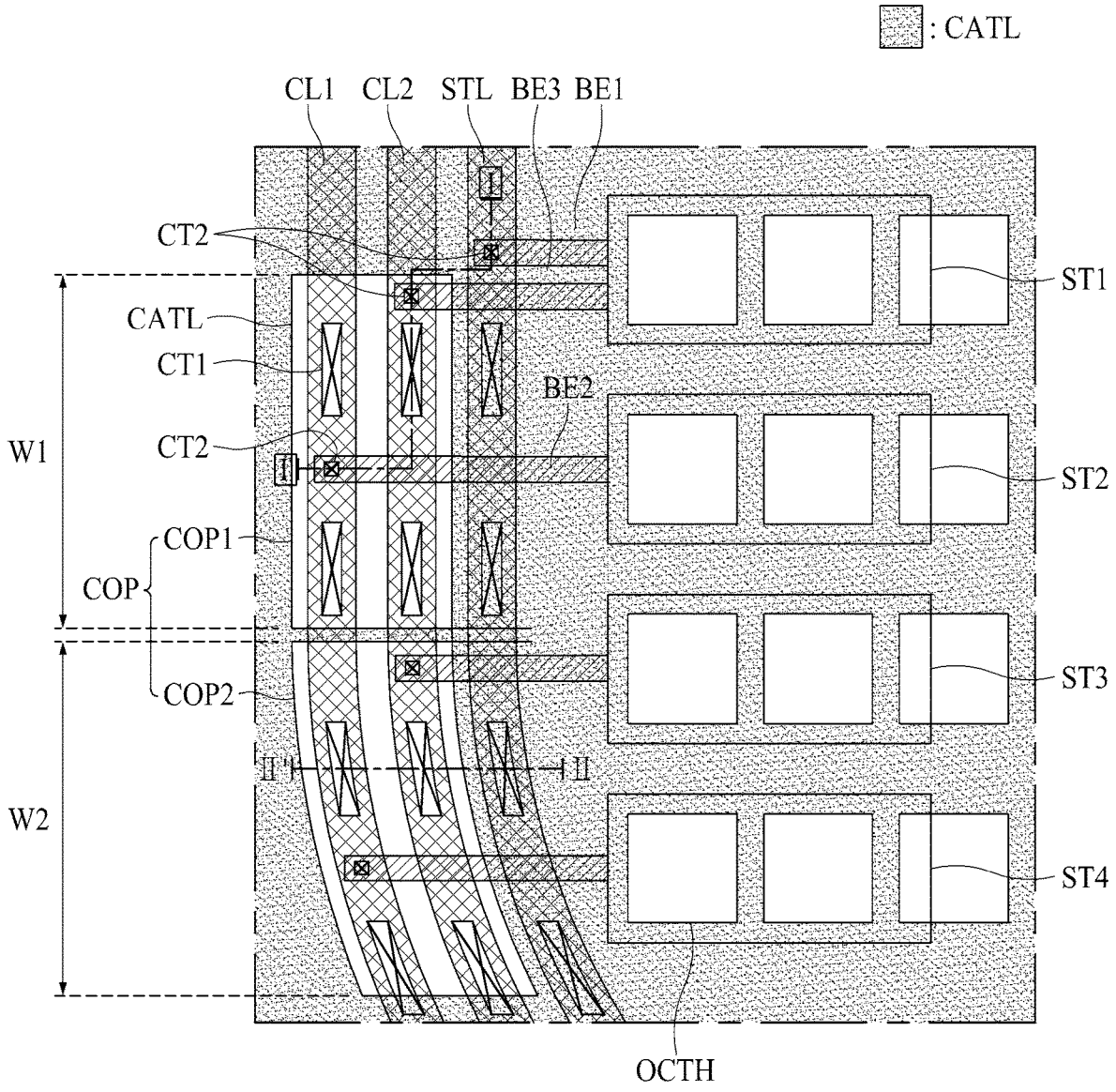
FIG. 13 is an exemplary diagram illustrating in detail a round part of FIG. 12 according to an embodiment of the present disclosure.

FIG. 13 is an exemplary diagram illustrating in detail a round part of FIG. 12. In FIG. 13, clock lines CL1 and CL2, a start line STL, first to fourth stages ST1 to ST4, a first bridge line BE1, a second bridge line BE2, a third bridge line BE3, a first contact hole CT1, a second contact hole CT2, a cathode auxiliary electrode CATL, and an outgas hole OUTH are substantially the same as the elements described above with reference to FIGS. 7 and 8, and thus, their detailed descriptions are omitted.

As illustrated in FIG. 13, a first clock line CL1, a second clock line CL2, and a start line STL of the first gate driver 11 may have a curve shape, based on the round part of the display panel 10. Therefore, the first clock line CL1, the second clock line CL2, and the start line STL may each have a straight section W1 and a curve section W2.

Referring to FIG. 13, the cathode auxiliary electrode CATL may be connected to a cathode electrode and may be provided in the non-display area to surround the display area AA, for stably supplying a low-level voltage to the cathode electrode. In this case, the cathode auxiliary electrode CATL may be provided on the first and second gate drivers 11 and 12.

The cathode auxiliary electrode CATL may include the outgas hole OUTH for emitting an outgas of a planarization layer. The planarization layer may be formed of resin such as photo acryl, polyimide, and/or the like, and thus, may absorb water when exposed to air. Therefore, water can remain on the planarization layer, and the water remaining on the planarization layer can evaporate to cause water vapor. Also, when the planarization layer is continuously exposed to ultraviolet (UV), an outgas can occur in the planarization layer. Also, a light emitting layer or the cathode electrode can be damaged by the water vapor and the outgas occurring in the planarization layer. Accordingly, the outgas hole OUTH of the cathode auxiliary electrode CATL may provide a path through which the outgas or the water vapor of the planarization layer is emitted, thereby preventing the light emitting layer or the cathode electrode from being damaged.

The outgas hole OUTH may include an outgas hole OUTH provided in each of stages ST1 to STn of the first and second gate drivers 11 and 12. Also, an opening COP of the cathode auxiliary electrode CATL disposed on the clock lines CL1 and CL2 or the start line STL corresponding to a gate control line or the clock lines CL1 and CL2 and the start line STL may be used as a path through the outgas is emitted.

If the cathode auxiliary electrode CATL overlaps the clock lines CL1 and CL2 and the start line STL, the low-level voltage supplied to the cathode auxiliary electrode CATL can be affected by a parasitic capacitance generated between the cathode auxiliary electrode CATL and each of the clock lines CL1 and CL2 and the start line STL. The opening COP of the cathode auxiliary electrode CATL may be provided in the clock lines CL1 and CL2 or the start line STL corresponding to the gate control line, or may be provided on the clock lines CL1 and CL2 and the start line STL corresponding to the gate control line, for reducing an adverse effect of the parasitic capacitance on the low-level voltage supplied to the cathode auxiliary electrode CATL.

As illustrated in FIG. 13, the cathode auxiliary electrode CATL is more affected by the parasitic capacitance between the cathode auxiliary electrode CATL and each of the clock lines CL1 and CL2 than the parasitic capacitance between the cathode auxiliary electrode CATL and the start line STL, and thus, the opening COP may be provided in only an area corresponding to each of the clock lines CL1 and CL2.

However, the present embodiment is not limited thereto, and the opening COP may extend to an area corresponding to the start line STL.

Moreover, if an area of the cathode auxiliary electrode CATL is reduced due to the outgas hole OUTH, the low-level voltage supplied to the cathode auxiliary electrode CATL can be lowered due to voltage drop. Accordingly, a size of the outgas hole OUTH provided in each of the stages ST1 to STn may be set less than that of the opening COP provided in each of the clock lines CL1 and CL2 corresponding to the gate control line.

Moreover, a first opening COP1 provided in the straight section W1 may have a rectangular shape, and a second opening COP2 provided in the curve section W2 may have a tetragonal shape where at least two sides are curve lines. In this manner, the second opening COP2 provided in the curve section W2 may be provided along a shape of the display panel 10.

Moreover, an area of the second opening COP2 provided in the curve section W2 may be set greater than that of the first opening COP1 provided in the straight section W1.

The clock lines CL1 and CL2 and the start line STL corresponding to a gate control line may each include first and second gate control lines disposed on different layers. Accordingly, in an embodiment of the present disclosure, loads of the clock lines CL1 and CL2 and the start line STL corresponding to the gate control line are reduced.

Figure 14:
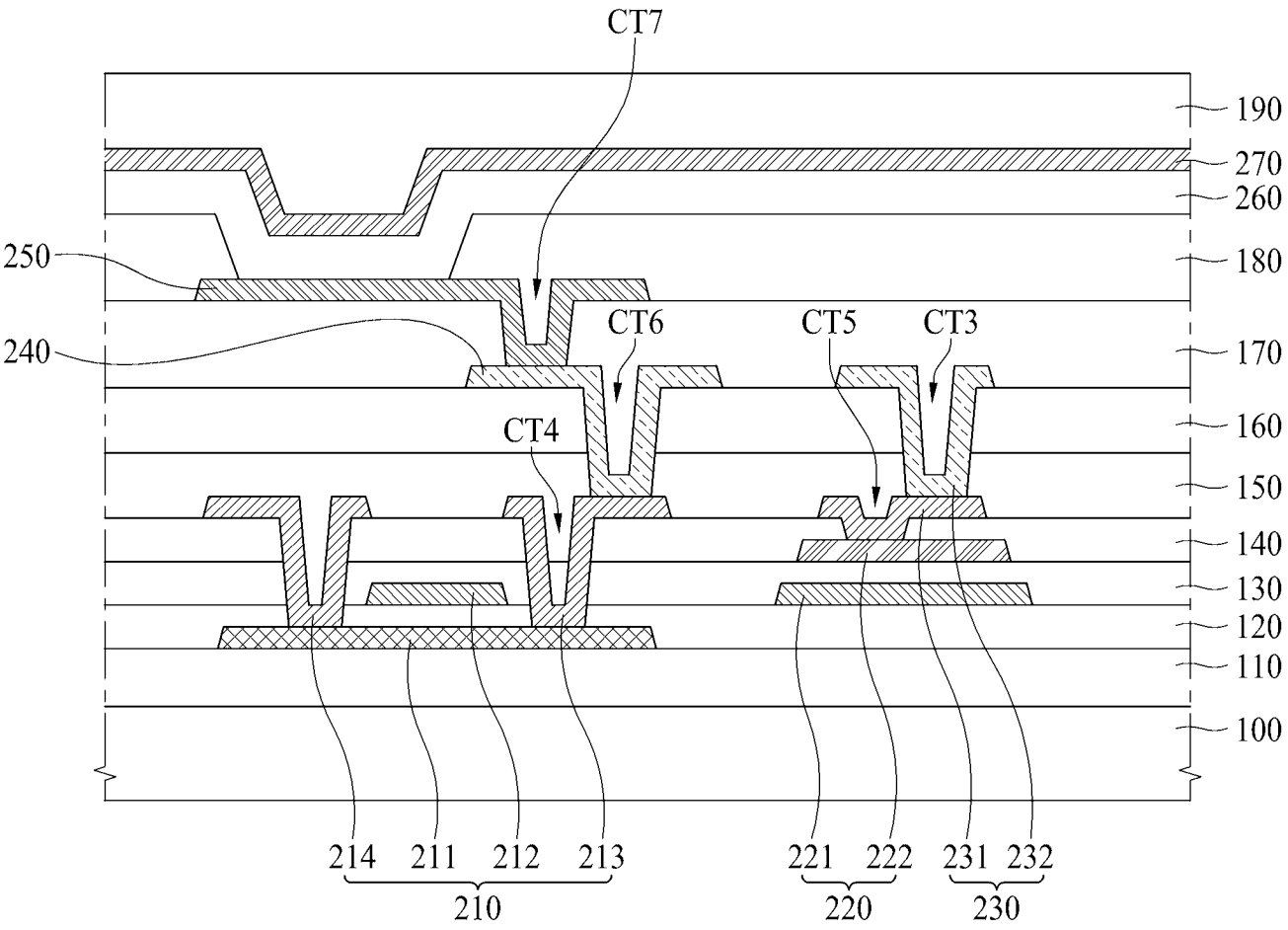
FIG. 14 is a cross-sectional view of a pixel in a display area of a display panel of FIG. 12 according to an embodiment of the present disclosure.

FIG. 14 is a cross-sectional view of a pixel in the display area AA of the display panel 10 of FIG. 12. In FIG. 14, an example where a pixel P includes an OLED including an anode electrode 250, a light emitting layer 260, and a cathode electrode 270 will be mainly described below.

Referring to FIG. 14, a buffer layer 110 may be provided on one surface of a lower substrate 100. The lower substrate 100 may be a plastic film, a glass substrate, or the like, but is not limited thereto. The buffer layer 110 may be provided on the one surface of the lower substrate 100, for protecting a plurality of TFTs 210 and a plurality of light emitting devices from water which penetrates through the lower substrate 100 vulnerable to penetration of water. The buffer layer 110 may include a plurality of inorganic layers which are alternately stacked. For example, the buffer layer 110 may be formed of a multilayer where one or more inorganic layers of silicon oxide (SiOx), silicon nitride (SiNx), and SiON are alternately stacked. The buffer layer 110 may be omitted.

A TFT 210, a capacitor 220, and a high level voltage line 230 may be provided on the buffer layer 110.

The TFT 210 may include an active layer 211, a gate electrode 212, a source electrode 213, and a drain electrode 214. In FIG. 14, the TFT 210 is exemplarily illustrated as being provided in a top gate type where the gate electrode 212 is disposed on the active layer 211, but is not limited thereto. In other embodiments, the TFT 210 may be provided in a bottom gate type where the gate electrode 212 is disposed under the active layer 211 or a double gate type where the gate electrode 212 is disposed both on and under the active layer 211.

The capacitor 220 may include a first capacitor electrode 221 and a second capacitor electrode 222. The high level voltage line 230 may include first and second high level voltage lines 231 and 232.

For example, the active layer 211 may be provided on the buffer layer 110. The active layer 211 may be formed of a silicon-based semiconductor material, an oxide-based semiconductor material, and/or the like. An insulation layer and a light blocking layer for blocking external light incident on the active layer 211 may be provided between the buffer layer 110 and the active layer 211.

A gate insulation layer 120 may be provided on the active layer 211. The gate insulation layer 120 may be formed of an inorganic layer, for example, silicon oxide (SiOx), silicon nitride (SiNx), or a multilayer thereof.

The gate electrode 212, the first capacitor electrode 221, and a gate line may be provided on the gate insulation layer 120. The first capacitor electrode 221 may extend from the gate electrode 212. The gate electrode 212, the first capacitor electrode 221, and the gate line may each be formed of a single layer or a multilayer which includes one of molybdenum (Mo), aluminum (Al), chromium (Cr), gold (Au), titanium (Ti), nickel (Ni), neodymium (Nd), and copper (Cu), or an alloy thereof.

A first interlayer dielectric 130 may be provided on the gate electrode 212, the first capacitor electrode 221, and the gate line. The first interlayer dielectric 130 may be formed of an inorganic layer, for example, SiOx, SiNx, or a multilayer thereof.

The second capacitor electrode 222 may be provided on the first interlayer dielectric 130. The second capacitor electrode 222 may be formed of a single layer or a multilayer which includes one of Mo, Al, Cr, Au, Ti, Ni, Nd, and Cu, or an alloy thereof.

A second interlayer dielectric 140 may be formed on the second capacitor electrode 222. The second interlayer dielectric 140 may be formed of an inorganic layer, for example, SiOx, SiNx, or a multilayer thereof.

The source electrode 213, the drain electrode 214, the first high level voltage line 231, and a data line may be provided on the second interlayer dielectric 140. The source electrode 213 and the drain electrode 214 may be connected to the active layer 211 through a fourth contact hole CT4 passing through the gate insulation layer 120 and the first and second interlayer dielectrics 130 and 140. The high level voltage line 231 may be connected to the second capacitor electrode 222 through a fifth contact hole CT5 passing through the second interlayer dielectric 140. The source electrode 213, the drain electrode 214, the first high level voltage line 231, and the data line may each be formed of a single layer or a multilayer which includes one of Mo, Al, Cr, Au, Ti, Ni, Nd, and Cu, or an alloy thereof.

A passivation layer 150 for insulating the TFT 210 may be provided on the source electrode 213, the drain electrode 214, the first high level voltage line 231, and the data line. The passivation layer 150 may be formed of an inorganic layer, for example, SiOx, SiNx, or a multilayer thereof.

A first planarization layer 160 for planarizing a step height caused by the TFT 210 may be provided on the passivation layer 150. The first planarization layer 160 may be formed of an organic layer such as acryl resin, epoxy resin, phenolic resin, polyamide resin, polyimide resin, and/or the like.

An anode auxiliary electrode 240 and the second high level voltage line 232 may be formed on the first planarization layer 160. The anode auxiliary electrode 240 may be connected to the source electrode 213 through a sixth contact hole CT6 passing through the passivation layer 150 and the first planarization layer 160. The second high level voltage line 232 may be connected to the first high level voltage line 231 through a third contact hole CT3 passing through the passivation layer 150 and the first planarization layer 160. The anode auxiliary electrode 240 and the second high level voltage line 232 may each be formed of a single layer or a multilayer which includes one of Mo, Al, Cr, Au, Ti, Ni, Nd, and Cu, or an alloy thereof. In FIG. 14, the anode auxiliary electrode 240 is illustrated as being connected to the source electrode 213, but is not limited thereto. In other embodiments, the anode auxiliary electrode 240 may be connected to the drain electrode 214.

A second planarization layer 170 may be provided on the anode auxiliary electrode 240 and the second high level voltage line 232. The second planarization layer 170 may be formed of an organic layer such as acryl resin, epoxy resin, phenolic resin, polyamide resin, polyimide resin, and/or the like.

A light emitting device and a bank 180 may be provided on the second planarization layer 170. The light emitting device may include an anode electrode 250, a light emitting layer 260, and a cathode electrode 270.

The anode electrode 250 may be provided on the second planarization layer 170. The anode electrode 250 may be connected to the anode auxiliary electrode 240 through a seventh contact hole CT7 passing through the second planarization layer 170. The anode electrode 250 may be formed of Al, silver (Ag), Mo, a stacked structure (Mo/Ti) of Mo and Ti, copper (Cu), a stacked structure (Ti/Al/Ti) of Al and Ti, a stacked structure (ITO/Al/ITO) of Al and indium tin oxide (ITO), an APC alloy, a stacked structure (ITO/APC/ITO) of an APC alloy and ITO, and/or the like. The APC alloy may be an alloy of Ag, palladium (Pd), and Cu.

The bank 180 may be provided to cover an edge of the anode electrode 250. Therefore, an emissive area of the pixel P may be defined by the bank 180. The emissive area of the pixel P may denote an area where the anode electrode 250, the light emitting layer 260, and the cathode electrode 270 are sequentially stacked, and a hole from the anode electrode 250 and an electron from the cathode electrode 270 are combined with each other to emit light in the light emitting layer 260. In this case, an area where the bank 180 is provided does not emit light, and thus, may be defined as a non-emissive area. The bank 180 may be formed of an organic layer such as acryl resin, epoxy resin, phenolic resin, polyamide resin, polyimide resin, and/or the like.

The light emitting layer 260 may be provided on the anode electrode 250 and the bank 180. The light emitting layer 260 may be provided as a common layer which is provided in the pixels P in common. If the light emitting layer 260 is provided as a common layer, the light emitting layer 260 may be a white light emitting layer that emits white light. In this case, the light emitting layer 260 may be provided in a tandem structure of two or more stacks. Each of the stacks may include a hole transporting layer, at least one light emitting layer and an electron transporting layer. Also, a charge generating layer may be formed between adjacent stacks.

The light emitting layer 260 may be patterned for each of the pixels P. In a case where the light emitting layer 260 is patterned for each pixel, the light emitting layer 260 may be patterned in a red light emitting layer pattern emitting red light, a green light emitting layer pattern emitting green light, and a blue light emitting layer pattern emitting blue light. Also, if the hole transporting layer and the electron transporting layer are further provided, the hole transporting layer and the electron transporting layer may each be provided as a common layer.

The hole transporting layer may smoothly transfer a hole, injected from the anode electrode 250 or the charge generating layer, to the light emitting layer 260. The light emitting layer 260 may be formed of an organic material including a phosphorescent material or a fluorescent material, and thus, may emit light. The electron transporting layer may smoothly transfer an electron, injected from the cathode electrode 270 or the charge generating layer, to the light emitting layer 260.

In a case where the light emitting layer 260 is provided in the tandem structure of two or more stacks, the charge generating layer may be provided. The charge generating layer may include an n-type charge generating layer, disposed adjacent to a lower stack, and a p-type charge generating layer which is provided on the n-type charge generating layer and is disposed adjacent to an upper stack. The n-type charge generating layer may inject an electron into the lower stack, and the p-type charge generating layer may inject a hole into the upper stack. The n-type charge generating layer may be formed of an organic layer which is doped with alkali metal, such as lithium (Li), sodium (Na), potassium (K), or cesium (Cs), or alkali earth metal such as magnesium (Mg), strontium (Sr), barium (Ba), or radium (Ra). The p-type charge generating layer may be an organic layer which is formed by doping a dopant on an organic host material having an ability to transport holes.

The cathode electrode 270 may be provided on the light emitting layer 260. The cathode electrode 270 may be a common layer which is provided in the pixels P in common. The cathode electrode 270 may be formed of a transparent conductive material (or TCO), such as indium tin oxide (ITO) or indium zinc oxide (IZO) capable of transmitting light, or a semi-transmissive conductive material such as Mg, Ag, or an alloy of Mg and Ag. In a case where the cathode electrode 270 is formed of the semi-transmissive conductive material, emission efficiency is enhanced by a micro-cavity. A capping layer may be provided on the cathode electrode 270.

An encapsulation layer 190 may be provided on the cathode electrode 270. The encapsulation layer 190 prevents oxygen or water from penetrating into the light emitting layer 260 and the cathode electrode 270. The encapsulation layer 190 may include at least one inorganic layer. The inorganic layer may be formed of silicon nitride, aluminum nitride, zirconium nitride, titanium nitride, hafnium nitride, tantalum nitride, silicon oxide, aluminum oxide, titanium oxide, and/or the like. Also, the encapsulation layer 190 may further include at least one organic layer, for preventing particles from penetrating into the light emitting layer 260 and the cathode electrode 270 via the inorganic layer.

A plurality of color filters and a black matrix may be provided on the encapsulation layer 190. The color filters may respectively disposed in correspondence with the emissive areas of the pixels P. The black matrix may be disposed between the color filters and may be disposed in correspondence with the bank 180.

The color filters and the black matrix may be provided on an upper substrate, and the upper substrate may be adhered to a lower substrate by using an adhesive layer. In this case, the color filters may be respectively disposed in correspondence with the emissive areas of the pixels P, and the black matrix may be disposed between the color filters and may be disposed in correspondence with the bank 180. The adhesive layer may be a transparent adhesive film, a transparent adhesive resin, or the like. The upper substrate may be a plastic film, a glass substrate, an encapsulation film (a protective film), or the like.

Figure 15:
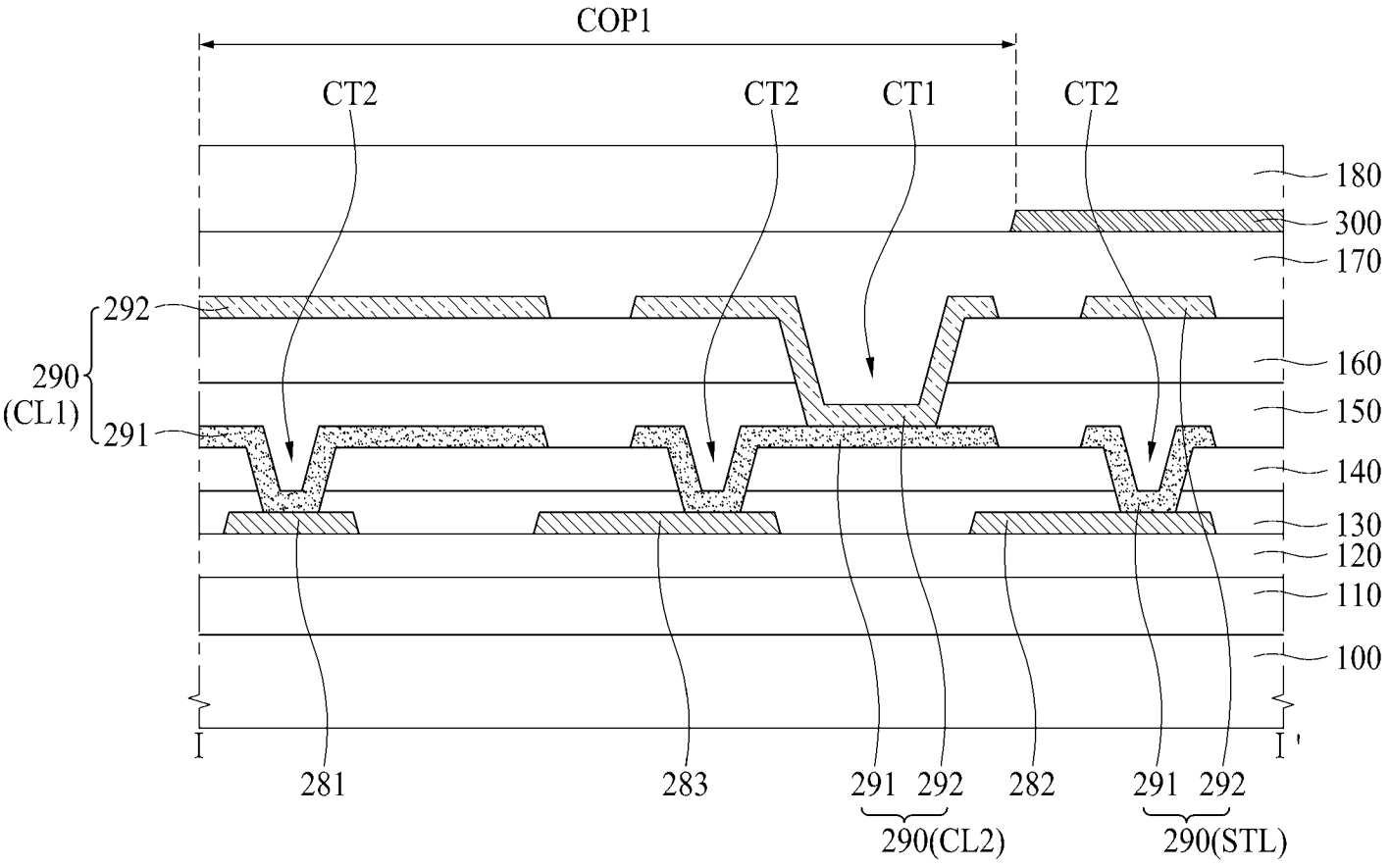
FIG. 15 is a cross-sectional view taken along line I-I' in a straight section of FIG. 13 according to an embodiment of the present disclosure.
Figure 16:
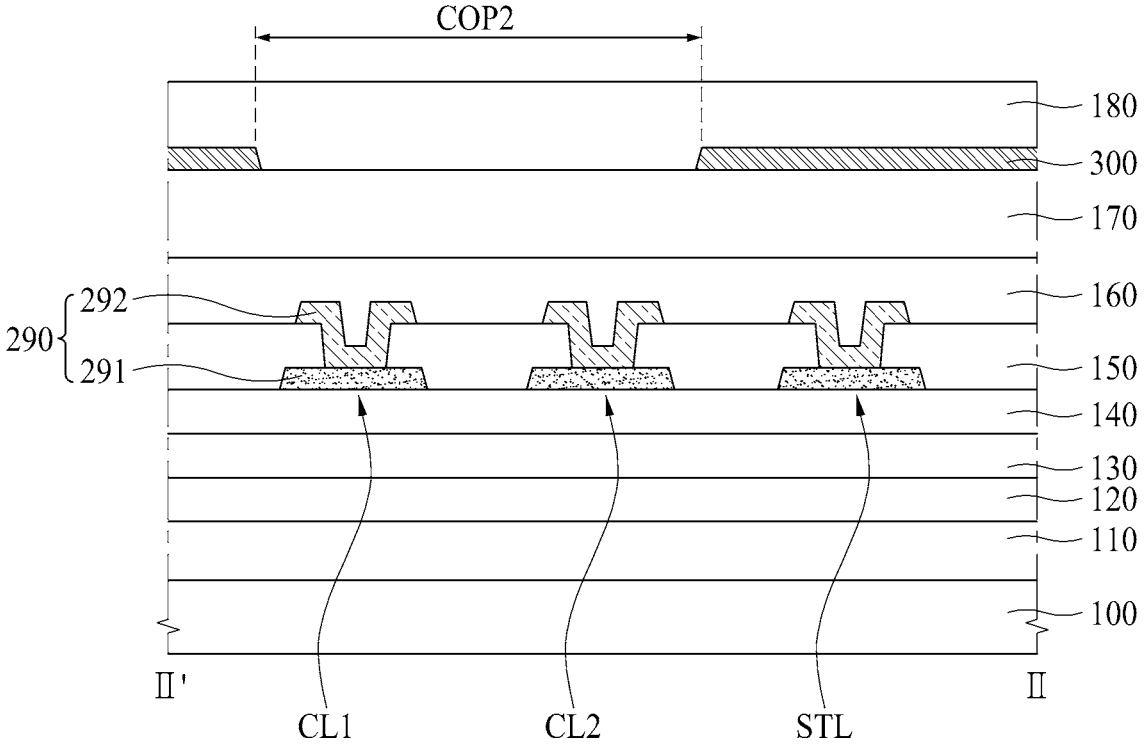
FIG. 16 is a cross-sectional view taken along line II-II' in a curve section of FIG. 13 according to an embodiment of the present disclosure.

FIG. 15 is a cross-sectional view taken along line I-I' in the straight section W1 of FIG. 13. FIG. 16 is a cross-sectional view taken along line II-II' in the curve section W2 of FIG. 13.

In FIGS. 15 and 16, the lower substrate 100, the buffer layer 110, the gate insulation layer 120, the first interlayer dielectric 130, the second interlayer dielectric 140, the passivation layer 150, the first planarization layer 160, the second planarization layer 170, and the bank 180 are substantially the same as the elements described above with reference to FIG. 14, and thus, their detailed descriptions are omitted.

Referring to FIGS. 15 and 16, first to third bridge lines 281 to 283 may be provided on the gate insulation layer 120. That is, the first to third bridge lines 281 to 283 may be formed of the same material and on the same layer as the gate electrode 212 of the TFT 210 and the first capacitor electrode 221.

Alternatively, the first to third bridge lines 281 to 283 may be provided on the first interlayer dielectric 130. In this case, the first to third bridge lines 281 to 283 may be formed of the same material and on the same layer as the second capacitor electrode 222.

A gate control line 290 such as the first and second clock lines CL1 and CL2 and the start line STL may include first and second gate control lines 291 and 292.

The first gate control line 291 may be provided on the second interlayer dielectric 140. In this case, the first gate control line 291 may be formed of the same material and on the same layer as the source electrode 213 and the drain electrode of the TFT 210 and the first high level voltage line 231. The first gate control line 291 may be connected to each of the first to third bridge lines 281 to 283 through a second contact hole CT2 passing through the second interlayer dielectric 140 or the first and second interlayer dielectrics 130 and 140.

The second gate control line 292 may be provided on the first planarization layer 160. In this case, the second gate control line 292 may be formed of the same material and on the same layer as the anode auxiliary electrode 240 and the second high level voltage line 232. The second gate control line 292 may be connected to the first gate control line 291 through a first contact hole CT1 passing through the passivation layer 150 and the first planarization layer 160.

The cathode auxiliary electrode 300 may be provided on the second planarization layer 170. Also, the cathode auxiliary electrode 300 may be formed of the same material as that of the anode electrode 250. Also, the cathode auxiliary electrode 300 may be provided on the same layer as the anode electrode 250. The opening COP of the cathode auxiliary electrode 300 may be provided on the gate control line 290. Therefore, in an embodiment of the present disclosure, the cathode auxiliary electrode 300 may not overlap the gate control line 290, and thus, the low-level voltage supplied to the cathode auxiliary electrode 300 is prevented from being affected by a parasitic capacitance generated between the cathode auxiliary electrode 300 and the gate control line 290.

Referring to FIG. 15, in the straight section W1, the first opening COP1 may be provided by removing a portion of the cathode auxiliary electrode 300 corresponding to the first clock line CL1 and the second clock line CL2.

Referring to FIG. 16, in the curve section W2, the second opening COP2 may be provided by removing a portion of the cathode auxiliary electrode 300 corresponding to the first clock line CL1 and the second clock line CL2.

The low-level voltage supplied to the cathode auxiliary electrode 300 is prevented from being affected by a parasitic capacitance generated between the cathode auxiliary electrode 300 and each of the clock lines CL1 and CL2. Also, the qualities, such as image quality and lifetime, of the display panel 10 are prevented from being degraded.

As described above, in an embodiment of the present disclosure, the second gate control line 292 may be provided between two planarization layers (for example, the first and second planarization layers 160 and 170) in the non-display area, and may be connected to the first gate control line 291 through the first contact hole CT1. Therefore, in an embodiment of the present disclosure, the second gate control line 292 may be formed in the same process as a process of forming the anode auxiliary electrode 240 and the second high level voltage line 232, and thus, without adding a separate process, the loads of the clock lines CL1 and CL2 and the start line STL corresponding to the gate control line are reduced. Accordingly, a problem where abnormal driving and a reduction in luminance uniformity are caused by an increase in load is solved.

A display device according to an embodiment of the present disclosure may include: a display panel including a display area including a plurality of pixels respectively provided in a plurality of intersection areas between a plurality of data lines and a plurality of gate lines; a gate driver disposed in a non-emissive area of the display panel, the gate driver including a plurality of stages supplying gate signals to the plurality of gate lines; and a gate control line for supplying a gate control signal to the plurality of stages, the gate control line including: a first gate control line; and a second gate control line overlapping the first gate control line with at least one insulation layer therebetween, the second gate control line being connected to the first gate control line through a first contact hole passing through the at least one insulation layer.

According to an embodiment of the present disclosure, the plurality of pixels may each include: a thin film transistor (TFT) including a gate electrode, a source electrode, and a drain electrode; an anode auxiliary electrode connected to the source electrode or the drain electrode of the TFT; and an anode electrode connected to the anode auxiliary electrode; a first capacitor electrode formed on the same material and on the same layer as the gate electrode; and a second capacitor electrode overlapping the first capacitor electrode, and the first gate control line may be formed of the same material and on the same layer as the source electrode and the drain electrode of the TFT, and the second gate control line is formed of the same material and the same layer as the anode auxiliary electrode.

According to an embodiment of the present disclosure, the display device may further include a bridge line connecting the first gate control line to some of the plurality of stages.

According to an embodiment of the present disclosure, the first gate control line may be connected to the bridge line through a second contact hole passing through an interlayer dielectric, and a size of the first contact hole may be greater than a size of the second contact hole.

According to an embodiment of the present disclosure, the bridge line may be formed of the same material and on the same layer as the gate electrode of the TFT.

According to an embodiment of the present disclosure, the display panel may further include a high level voltage line through which a high-level voltage is supplied, the high level voltage line including: a first high level voltage line; and a second high level voltage line overlapping the first high level voltage line with the at least one insulation layer therebetween, the second high level voltage line being connected to the first high level voltage line through a third contact hole passing through the at least one insulation layer.

According to an embodiment of the present disclosure, the first gate control line may be formed of the same material and on the same layer as the first high level voltage line, and the second gate control line is formed of the same material and on the same layer as the second high level voltage line.

According to an embodiment of the present disclosure, the second capacitor electrode may be connected to the first high level voltage line.

According to an embodiment of the present disclosure, the second capacitor electrode may be disposed between the first capacitor electrode and the first high level voltage line.

According to an embodiment of the present disclosure, the display device may further include a cathode auxiliary electrode disposed on the plurality of stages and the gate control line.

According to an embodiment of the present disclosure, the cathode auxiliary electrode may include: a first outgas hole provided on the plurality of stages; and a second outgas hole provided on the gate control line.

According to an embodiment of the present disclosure, a size of the first outgas hole may be less than a size of the second outgas hole.

According to an embodiment of the present disclosure, the gate control line may include a straight section and a curve section, and wherein the second outgas hole may include a first opening on the straight section and a second opening on the curve section, an area of the second opening may be greater than an area of the first opening, and the area of the first outgas hole may be less than the area of each of the first opening and the second opening.

According to an embodiment of the present disclosure, the plurality of pixels may each include: a thin film transistor (TFT) including a gate electrode, a source electrode, and a drain electrode; an anode auxiliary electrode connected to the source electrode or the drain electrode of the TFT; and an anode electrode connected to the anode auxiliary electrode, and the cathode auxiliary electrode may be formed of the same material and on the same layer as the anode electrode.

According to an embodiment of the present disclosure, the display device may further include a cathode electrode provided in the display area, the cathode electrode being connected to the cathode auxiliary electrode.

A display device According to an embodiment of the present disclosure may include: a display panel including a display area including a plurality of pixels respectively provided in a plurality of intersection areas between a plurality of data lines and a plurality of gate lines; a gate driver in a non-emissive area of the display panel, the gate driver including a plurality of stages supplying gate signals to the plurality of gate lines; and a gate control line for supplying a gate control signal to the plurality of stages; and a cathode auxiliary electrode on the plurality of stages and the gate control line, wherein the cathode auxiliary electrode may include: a first outgas hole provided on the plurality of stages; and a second outgas hole on the gate control line.

According to an embodiment of the present disclosure, a size of the first outgas hole may be less than a size of the second outgas hole.

According to an embodiment of the present disclosure, the gate control line may include a straight section and a curve section, and wherein the second outgas hole may include a first opening on the straight section and a second opening on the curve section, an area of the second opening may be greater than an area of the first opening, and the area of the first outgas hole may be less than the area of each of the first opening and the second opening.

According to an embodiment of the present disclosure, the plurality of pixels may each include: a thin film transistor (TFT) including a gate electrode, a source electrode, and a drain electrode; an anode auxiliary electrode connected to the source electrode or the drain electrode of the TFT; and an anode electrode connected to the anode auxiliary electrode, and the cathode auxiliary electrode may be formed of the same material and on the same layer as the anode electrode.

According to an embodiment of the present disclosure, the display device may further include a cathode electrode provided in the display area, the cathode electrode being connected to the cathode auxiliary electrode.

According to an embodiment of the present disclosure, the gate control line may include a first gate control line and a second gate control line disposed on a layer different from the first gate control line, and the first gate control line may be connected to the second gate control line through a contact hole of an insulation layer disposed between the first gate control line and the second gate control line.

A display device according to an embodiment of the present disclosure may include: a display panel including a display area and a non-display area adjacent to the display area; a gate driver provided in the non-display area of the display panel; a gate control line for supplying a gate control signal to the gate driver; and a cathode auxiliary electrode disposed in the non-display area, the cathode auxiliary electrode including an outgas hole. Also, the gate control line may include a first gate control line and a second gate control line disposed on different layers, and the first gate control line may be connected to the second gate control line through a contact hole of an insulation layer disposed between the first gate control line and the second gate control line.

According to an embodiment of the present disclosure, the display panel may include a plurality of pixels, and the plurality of pixels may each include: a thin film transistor including a gate electrode, a source electrode, and a drain electrode; and an anode auxiliary electrode connected to the source or drain electrode of the thin film transistor. Also, the first gate control line may be formed of the same material and on the same layer as the source electrode and the drain electrode of the thin film transistor, and the second gate control line may be formed of the same material and on the same layer as the anode auxiliary electrode.

According to an embodiment of the present disclosure, the display panel may include a high level voltage line through which a high-level voltage is supplied, and the high level voltage line may include a first high level voltage line and a second high level voltage line provided on different layers. Also, the second high level voltage line may be connected to the first high level voltage line through another contact hole.

According to an embodiment of the present disclosure, the first gate control line may be formed of the same material and on the same layer as the first high level voltage, and the second gate control line may be formed of the same material and on the same layer as the second high level voltage.

According to an embodiment of the present disclosure, the gate driver may include a plurality of stages, and the cathode auxiliary electrode may be provided on the plurality of stages and the gate control line.

According to an embodiment of the present disclosure, the cathode auxiliary electrode may include: a first outgas hole provided on each of the plurality of stages; and a second outgas hole provided on the gate control line.

According to an embodiment of the present disclosure, a size of the first outgas hole may be less than a size of the second outgas hole.

According to an embodiment of the present disclosure, the gate control line may include a straight section and a curve section, and wherein the second outgas hole may include a first opening on the straight section and a second opening on the curve section, an area of the second opening may be greater than an area of the first opening, and the area of the first outgas hole may be less than the area of each of the first opening and the second opening.

A display device according to an embodiment of the present disclosure may include: a display panel including a display area and a non-display area adjacent to the display area and including a gate line, a data line, and a pixel provided in the display area; a gate driver including a stage for supplying a gate signal to the gate line, the gate driver being provided in the non-display area; a gate control line for supplying a gate control signal to the stage, the gate control line including a first clock line, a second clock line, and a start line; and a cathode auxiliary electrode overlapping the gate control line and the stage in the non-display area and including an opening corresponding to an area of the gate control line and an outgas hole corresponding to an area of the stage. Also, the first clock line, the second clock line, and the start line of the gate control line may include a first line on a first insulation layer and a second line on the first line, and the second line may be connected to the first line through a contact hole of a second insulation layer inserted between the second line and the first line.

According to an embodiment of the present disclosure, the opening may be disposed in an area corresponding to the first clock line and the second clock line.

According to an embodiment of the present disclosure, at least two of a plurality of corners of the display panel may have a curve-shaped round part.

According to an embodiment of the present disclosure, the first clock line, the second clock line, and the start line of the gate control line may each include a straight section corresponding to one side of the display panel and a curve section corresponding to the round part of the display panel.

According to an embodiment of the present disclosure, the opening of the cathode auxiliary electrode may include a first opening, disposed in area corresponding to the straight section of each of the first clock line and the second clock line, and a second opening disposed in area corresponding to the curve section of each of the first clock line and the second clock line.

According to an embodiment of the present disclosure, a size of the second opening may be greater than a size of the first opening.

As described above, according to the embodiments of the present disclosure, the start line and the clock lines corresponding to the gate control line may each include the first gate control line and the second gate control line which are disposed on different layers. As a result, according to the embodiments of the present disclosure, the loads of the start line and the clock lines corresponding to the gate control line are reduced.

Moreover, according to the embodiments of the present disclosure, the second gate control line may be provided in a space between two planarization layers (i.e., the first and second planarization layers) in the non-display area, and may be connected to the first gate control line through the first contact hole. As a result, according to the embodiments of the present disclosure, the second gate control line may be formed in the same process as a process of forming the anode auxiliary electrode and the second high level voltage line, and thus, a separate process is not added in forming the second gate control line.

Moreover, according to the embodiments of the present disclosure, the second outgas hole may be formed on the clock lines and the start line corresponding to the gate control line. As a result, according to the embodiments of the present disclosure, the cathode auxiliary electrode may not overlap the gate control line, and thus, a low-level voltage supplied to the cathode auxiliary electrode is prevented from being affected by a parasitic capacitance between the cathode auxiliary electrode and the gate control line.

Furthermore, according to the embodiments of the present disclosure, a size of the first outgas hole formed on the stages may be set less than that of the second outgas hole which is formed on the clock lines and the start line corresponding to the gate control line. Accordingly, according to the embodiments of the present disclosure, a degree to which an area of the cathode auxiliary electrode is reduced due to the outgas hole is minimized.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display device comprising:

a display panel including a plurality of data lines, a plurality of gate lines, and a plurality of pixels in a display area;

a gate driver in a non-display area of the display panel, the gate driver supplying gate signals to the plurality of gate lines; and a gate control line for supplying a gate control signal to the gate driver, the gate control line including:

a first gate control line, and a second gate control line overlapping the first gate control line with an insulation layer therebetween, the second gate control line being connected to the first gate control line through a first contact hole passing through the insulation layer; and a cathode auxiliary electrode that does not overlap the first gate control line and the second gate control line, wherein the gate driver includes a plurality of stages, the cathode auxiliary electrode is disposed on the plurality of stages and the gate control line, the cathode auxiliary electrode comprises a first outgas hole provided on the plurality of stages and a second outgas hole on the first gate control line or the second gate control line, the gate control line includes a straight section and a curve section, the second outgas hole includes a first opening on the straight section and a second opening on the curve section, and an area of the first outgas hole is less than an area of each of the first opening and the second opening.

2. The display device of claim 1, wherein each of the plurality of stages is connected to a corresponding one of the plurality of gate lines, wherein the first gate control line or the second gate control line is connected to some of the plurality of stages.

3. The display device of claim 1, wherein the plurality of pixels each comprise:

a thin film transistor (TFT) including a gate electrode, a source electrode, and a drain electrode;

an anode auxiliary electrode connected to the source electrode or the drain electrode of the TFT;

an anode electrode connected to the anode auxiliary electrode;

a first capacitor electrode formed of a same material and on a same layer as the gate electrode of the TFT; and a second capacitor electrode overlapping the first capacitor electrode;

wherein the first gate control line is formed of a same material and on a same layer as the source electrode and the drain electrode of the TFT, and the second gate control line is formed of a same material and on a same layer as the anode auxiliary electrode.

4. The display device of claim 3, further comprising:

a bridge line connecting the first gate control line to some of the plurality of stages.

5. The display device of claim 4, wherein the first gate control line is connected to the bridge line through a second contact hole passing through an interlayer dielectric, and a size of the first contact hole is greater than a size of the second contact hole.

6. The display device of claim 4, wherein the bridge line is formed of the same material and on the same layer as the gate electrode of the TFT.

7. The display device of claim 3, wherein the display panel further comprises a high level voltage line through which a high-level voltage is supplied, the high level voltage line including:

a first high level voltage line; and a second high level voltage line overlapping the first high level voltage line with the insulation layer therebetween, the second high level voltage line being connected to the first high level voltage line through a third contact hole passing through the insulation layer.

8. The display device of claim 7, wherein the first gate control line is formed of a same material and on a same layer as the first high level voltage line, and the second gate control line is formed of a same material and on a same layer as the second high level voltage line.

9. The display device of claim 8, wherein the second capacitor electrode is disposed between the first capacitor electrode and the first high level voltage line.

10. The display device of claim 7, wherein the second capacitor electrode being connected to the first high level voltage line.

11. The display device of claim 1, wherein the area of the second opening is greater than the area of the first opening.

12. The display device of claim 1, wherein the plurality of pixels each comprise:

a thin film transistor (TFT) including a gate electrode, a source electrode, and a drain electrode;

an anode auxiliary electrode connected to the source electrode or the drain electrode of the TFT; and an anode electrode connected to the anode auxiliary electrode, and the cathode auxiliary electrode is formed of a same material and on a same layer as the anode electrode.

13. The display device of claim 1, further comprising: a cathode electrode in the display area, the cathode electrode being connected to the cathode auxiliary electrode.

14. A display device comprising:

a display panel including a plurality of data lines, a plurality of gate lines, and a plurality of pixels in a display area;

a gate driver in a non-display area of the display panel, the gate driver including a plurality of stages, each of the plurality of stages connected to each of the plurality of gate lines respectively;

a gate control line for supplying a gate control signal to the plurality of stages;

a planarization layer on the plurality of stages and the gate control line; and a cathode auxiliary electrode on the planarization layer, wherein the cathode auxiliary electrode does not overlap the plurality of stages and the gate control line, wherein the cathode auxiliary electrode is disposed on the plurality of stages and the gate control line, the cathode auxiliary electrode comprises a first outgas hole provided on the plurality of stages and a second outgas hole on the gate control line, the gate control line includes a straight section and a curve section, the second outgas hole includes a first opening on the straight section and a second opening on the curve section, and an area of the first outgas hole is less than an area of each of the first opening and the second opening.

15. The display device of claim 14, wherein the area of the second opening is greater than the area of the first opening.

16. The display device of claim 14, wherein the plurality of pixels each comprise:

a thin film transistor (TFT) including a gate electrode, a source electrode, and a drain electrode;

an anode auxiliary electrode connected to the source electrode or the drain electrode of the TFT; and an anode electrode connected to the anode auxiliary electrode, and the cathode auxiliary electrode is formed of a same material and on a same layer as the anode electrode.

17. The display device of claim 14, further comprising:

a cathode electrode in the display area, the cathode electrode connected to the cathode auxiliary electrode.

18. The display device of claim 14, the gate control line includes a first gate control line and a second gate control line disposed on a layer different from the first gate control line, and the first gate control line is connected to the second gate control line through a contact hole of an insulation layer disposed between the first gate control line and the second gate control line.

19. A display device comprising:

a display panel including a display area and a non-display area adjacent to the display area;

a gate driver in the non-display area of the display panel;

a gate control line disposed for supplying a gate control signal to the gate driver; and a cathode auxiliary electrode disposed in the non-display area and including an outgas hole, wherein the gate control line includes first and second gate control lines disposed on different layers, the first and second gate control lines being connected to each other through a contact hole, wherein the cathode auxiliary electrode does not overlap the first and second gate control lines, the gate driver includes a plurality of stages, the cathode auxiliary electrode is formed on the plurality of stages and the gate control line, the cathode auxiliary electrode comprises a first outgas hole provided on the plurality of stages and a second outgas hole on the gate control line, the gate control line includes a straight section and a curve section, the second outgas hole includes a first opening on the straight section and a second opening on the curve section, and an area of the first outgas hole is less than an area of each of the first opening and the second opening.

20. The display device of claim 19, wherein the display panel includes a plurality of pixels, each pixel comprising:

a thin film transistor (TFT) including a gate electrode, a source electrode, and a drain electrode; and an anode auxiliary electrode connected to the source electrode or the drain electrode of the TFT, wherein the first gate control line is formed of a same material and on a same layer as the source electrode and the drain electrode of the TFT, and the second gate control line is formed of a same material and on a same layer as the anode auxiliary electrode.

21. The display device of claim 19, wherein the display panel comprises a high level voltage line through which a high-level voltage is supplied, the high level voltage line including a first high level voltage line and a second high level voltage line disposed on different layers, the second high level voltage line being connected to the first high level voltage line through another contact hole.

22. The display device of claim 21, wherein the first gate control line is formed of a same material and on a same layer as the first high level voltage line, and the second gate control line is formed of a same material and on a same layer as the second high level voltage line.

23. The display device of claim 19, wherein the area of the second opening is greater than the area of the first opening.

* * * * *